US007343969B1

(12) United States Patent
Busch et al.

(10) Patent No.: US 7,343,969 B1
(45) Date of Patent: Mar. 18, 2008

(54) SECONDARY PACKING ARRANGEMENT FOR RECIPROCATING PUMP POLISHED ROD

(76) Inventors: Randolph A. Busch, 800 Plainview Rd., Wimberley, TX (US) 78676; Harrold H. Palmour, 1302 Tom Temple Dr., #129, Lufkin, TX (US) 75904-5551

( * ) Notice: Subject to any disclaimer, the term of this patent is extended or adjusted under 35 U.S.C. 154(b) by 205 days.

(21) Appl. No.: 11/199,106

(22) Filed: Aug. 8, 2005

Related U.S. Application Data

(60) Provisional application No. 60/600,183, filed on Aug. 10, 2004.

(51) Int. Cl.
*E21B 19/00* (2006.01)

(52) U.S. Cl. ..... 166/84.4; 166/84.1; 166/84.2; 166/69; 166/387

(58) Field of Classification Search ..... 166/387, 166/84.2, 84.4, 69, 71, 77.4, 84.1, 105.2, 166/84.5
See application file for complete search history.

(56) References Cited

U.S. PATENT DOCUMENTS 5,209,495 A 5/1993 Palmour
5,538,080 A * 7/1996 Bassinger ..... 166/84.2
6,158,967 A 12/2000 Dupre
6,302,401 B1 10/2001 Palmour
6,394,461 B1 5/2002 Henderson
2003/0184019 A1* 10/2003 Rimmer ..... 277/323

OTHER PUBLICATIONS

Trico Industries, Inc.'s Bulletin HBSB-May. 1997.
Trico Industries, Inc.'s Bulletin HBSB-2 (Aug. 1997).
Trico Industries, Inc.'s Paper "A Positive Solution to a Universal Envioronmental Problem"Jan. 4, 1999.

* cited by examiner

*Primary Examiner*—Jennifer H. Gay
*Assistant Examiner*—Brad Harcourt
(74) *Attorney, Agent, or Firm*—George S. Gray

(57) ABSTRACT

A secondary packing arrangement is provided for use with a well having a reciprocating pump and polished rod, and in combination with a stuffing box, the stuffing box being modified. Packing seals, a barrier fluid and a pressure transmitter cooperate with modified stuffing box components to regulate the pressure on either side of a packing seal. The barrier fluid is contained above the packing seal, with well fluids and accompanying pressures being contained below the packing seal, such that if leakage occurs, relatively clean barrier fluids are leaked instead of well fluids. The pressure across the packing seal is substantially balanced across the packing seal, or the well fluid side pressure is less than the barrier fluid side, thus reducing the occurrence of leakage and extending the life of the packing seal. Sources for the well fluids cooperating with the pressure transmitter include the well's flow line and casing.

28 Claims, 20 Drawing Sheets

20
200
10
21
23
25
27
36
204
49
202
126
128
130
32
70
38
22
34
205
114
122
100

206

206

20
300
306
302
304
10
32
22
308
100

302
304
306
32
220
232
10
308
202

SECONDARY PACKING ARRANGEMENT FOR RECIPROCATING PUMP POLISHED ROD

CROSS-REFERENCE TO RELATED APPLICATION

This application claims priority from U.S. Provisional Patent Application Ser. No. 60/600,183, filed Aug. 10, 2004, the inventors being Randolph A. Busch and Harold H. Palmer.

BACKGROUND OF THE INVENTION

1. Field of the Invention

The field of the invention is reciprocating pump polished rod packing seals.

2. Description of Related Art

Over 75 percent of artificially lifted producing oil wells are being produced with sucker rod pumping systems, with the sucker rod string terminating in a polished rod that extends from the well head to the atmosphere. Stuffing boxes, having packing seals about the polished rod, are utilized to prevent well fluids from escaping around the polished rod. Well fluids include corrosive hydrocarbons including salt water and natural gas.

Due to the wear and tear of the moving polished rod, the corrosiveness of some well fluids, and the pressure drop across the packing seal in the stuffing box, all stuffing boxes on sucker rod pumping systems will leak at some time, requiring the primary packing seals in conventional stuffing boxes to be replaced periodically.

What is needed is a more simplified, unique, flexible, pressure-regulating secondary packing arrangement in a unitized assembly, readily adapted to any manufacturer's stuffing box in the field or on new installations.

SUMMARY OF THE INVENTION

The present invention overcomes the shortcomings of the prior art by providing apparatus for a secondary packing arrangement that, when used with a conventional stuffing box on a reciprocating plunger type pump having a polished rod, provides a pressure transmitter to create opposing pressures across a packing seal, the pressure being equal to or greater than the corresponding well fluid pressure at any given time during the pumping cycle. In some exemplary embodiments, the secondary packing arrangement includes a first chamber separated by a packing seal from a second chamber formed between the packing seal and the primary packing seal of the conventional stuffing box. The first chamber accepts well fluids, that in some exemplary embodiments are then routed to a pressure transmitter, which transmits the well fluids pressure to a more environmentally acceptable barrier fluid in the second chamber, such that when leakage occurs from the primary packing seal in the stuffing box, the leakage will be barrier fluid. Regulating the opposing pressures across the packing seal in this secondary packing arrangement provides the optimum operating condition for the packing seal elements, thus increasing the life of the elements.

In the case of the previously described secondary seal arrangement, i.e. the primary and secondary seals, the barrier fluid is sealed from the atmosphere, in some exemplary embodiments, by the primary seal in the conventional stuffing box. The consumption of the barrier fluid will be due mainly to leakage past the primary seal and evaporation of the barrier fluid film from the surface of the polished rod. Leakage past the primary seal is a function of the seal load and wear rate, for a given pressure. Increased seal load improves sealing, but also increases wear rate due to increased friction. The load, or squeeze, of the primary seal is adjusted by threaded bolts, and manually set by the operator. In order to reduce this operator induced uncertainty with respect to the rate of barrier fluid consumption, an alternative seal arrangement has been devised.

In such an exemplary embodiment (See FIG. 11), an intermediate seal is placed in the lower housing, above the secondary seal, so as to reside between the primary and secondary seals. The load, or squeeze, of the intermediate seal is automatically set upon assembly and is not adjustable. The barrier fluid will then fill the area between the secondary and intermediate seals, and act to regulate the pressure across the secondary seal, just as in the previous seal arrangement. The intermediate seal, although exposed to a pressure differential at least equal to the well fluids pressure, will only come in contact with the clean barrier fluid. The primary seal will remain in place to contain the barrier fluid in the event of intermediate seal wear to the point of leakage. Since the primary seal will not need to be highly loaded, the decreased friction should result in less wear and reduced horsepower requirements.

The concept of hydro-balancing the pressure across the secondary seal of a stuffing box is the subject of Harold Palmour's U.S. Pat. No. 5,209,495 and U.S. Pat. No. 6,302,401. However, the present invention is a more simplified, unique, flexible pressure-balancing/regulating secondary packing arrangement in a unitized assembly, readily adapted to any manufacturer's stuffing box in the field or on new installations.

Additionally, the secondary packing arrangement of our invention prevents corrosive well fluids from contacting the packing seal elements in the conventional stuffing box, thus increasing the life of the packing seal elements in the stuffing box.

The application of this technology to sucker rod pumping systems will overcome the universal problem of losing production and polluting the area around the well head.

For a well producing at least first and second quantities of well fluids, and in combination with a reciprocating plunger type pump having a polished rod, and a stuffing box through which the polished rod moves, the stuffing box having a stuffing box packing seal, we have provided a secondary packing arrangement, through which the polished rod moves, the secondary packing arrangement, comprising: a housing having a top member and a chamber; a packing assembly, positioned within the housing chamber, through which the polished rod moves, the packing assembly having: a cylinder, the cylinder having an outer wall sealed against the housing; a packing seal, having at least one packing seal element, the packing seal having a top and a bottom, the packing seal and the cylinder dividing the housing chamber into a first chamber and a second chamber, the first chamber containing the first well fluid quantity, the second chamber in fluidic communication with the stuffing box packing seal; a retaining member supporting the packing seal, such that the first well fluid pressures the packing seal bottom; and a cap on the cylinder, the cap having fluid passages; a barrier fluid in the housing second chamber, the barrier fluid pressurably engaging the packing seal top through the cap fluid passages; and a pressure transmitter having a cylinder and a piston within the cylinder, the cylinder having a well fluid communication end, the well fluid communication end fluidically communicating with the second well fluid quantity such that the second well fluid quantity pressures the piston, the cylinder having a barrier fluid communication end, the barrier fluid communication end fluidically communicating with the housing second chamber, such that the barrier fluid pressurably engages the piston; the piston being sized such that the pressure from the second well fluid quantity on the piston is transmitted to the barrier fluid, the barrier fluid pressure opposing the first well fluid quantity pressure exerted by the first well fluid quantity on the packing assembly packing seal bottom. In some exemplary embodiments the barrier fluid pressure and the first well fluid quantity pressure are substantially balanced across the packing assembly packing seal.

In some exemplary embodiments the barrier fluid pressure is not less than the first well fluid quantity pressure, across the packing assembly packing seal.

In some exemplary embodiments the second well fluid quantity is routed from the housing first chamber to the pressure transmitter cylinder well fluid communication end.

In some exemplary embodiments the well has a flow line transporting produced well fluids, and further wherein the second well fluid quantity is routed from the well flow line to the pressure transmitter cylinder well fluid communication end.

In some exemplary embodiments the well has a casing, the well accumulating pressured gas in the casing, and further wherein the second well fluid quantity is routed from the casing to the pressure transmitter cylinder well fluid communication end.

In some exemplary embodiments the packing assembly cylinder has a top portion and bottom portion, the bottom portion being sealed against the housing and against the top portion and affixed within the housing chamber for no movement, the top portion being free for lateral movement, the packing seal being positioned within the cylinder top portion.

In some exemplary embodiments the housing top member bears upon the packing assembly cap, the barrier fluid passing laterally through the cap.

In some exemplary embodiments the secondary packing arrangement the packing assembly cylinder has an upper and lower portion, the upper portion having a groove, and further comprises an o-ring positioned within the groove for sealing the cylinder upper portion against the cylinder lower portion, and further comprises a wave spring positioned between the housing top member and the packing assembly cap, such that the housing top member bears upon the packing assembly cap through the wave spring, thereby maintaining a load on the cylinder upper portion and the o-ring.

In some exemplary embodiments the stuffing box threadably attaches to the housing top member.

In some embodiments, the barrier fluid is selected from the group consisting of hydrocarbon based, vegetable based, and animal fat based fluids.

In some exemplary embodiments the retaining member comprises a washer and a snap ring, the washer being sized for a clearance between the washer and the polished rod, the snap ring expanding against the cylinder and supporting the washer, the washer supporting the packing seal.

In some exemplary embodiments the pressure transmitter comprises means for adding additional barrier fluid.

In some exemplary embodiments the pressure transmitter cylinder well fluid communication end has a hole, and further comprising a rod attached to the pressure transmitter cylinder piston, the rod extruding through the cylinder well fluid communication end hole, such that, as the amount of barrier fluid in the cylinder barrier fluid communication end and the housing second chamber decreases, the rod extrusion from the cylinder is decreased.

In some exemplary embodiments the rod includes indicia related to the amount of barrier fluid.

In some exemplary embodiments the pressure transmitter cylinder barrier fluid communication end has a hole, and further comprising a rod attached to the pressure transmitter cylinder piston, the rod extruding through the cylinder barrier fluid communication end hole, such that, as the amount of barrier fluid in the cylinder barrier fluid communication end and the housing second chamber decreases, the rod extrusion from the cylinder is increased.

In some exemplary embodiments the rod includes indicia related to the amount of barrier fluid.

In some exemplary embodiments the well fluid is within the group consisting of water, oil, and hydrocarbon gas.

For a well producing at least first and second quantities of well fluids, and in combination with a reciprocating plunger type pump having a polished rod, and a stuffing box through which the polished rod moves, the stuffing box providing a stuffing box packing seal, we have provided a secondary packing arrangement through which the polished rod moves, the secondary packing arrangement comprising: a housing having a top member and a chamber; a packing assembly, positioned within the housing chamber, through which the polished rod moves, the packing assembly having: a cylinder, the cylinder having an outer wall sealed against the housing; a lower packing seal, having at least one packing seal element, the packing seal having a top and a bottom, the packing seal and the cylinder dividing the housing chamber into a first chamber and a second chamber, the first chamber containing the first well fluid quantity; a retaining member supporting the packing seal, such that the first well fluid quantity pressures the lower packing seal bottom; and a cap on the cylinder, the cap having: a first member and a second member, the polished rod moving through the first and second members, the first member having fluid passages; an intermediate packing seal, the intermediate packing seal being positioned adjacent the polished rod by the first and second members; the cap first member being sealed against the housing and against the second member, the cap defining a third chamber between the cap and the stuffing box packing seal; a barrier fluid in the housing second chamber, the barrier fluid pressurably engaging both the lower and intermediate packing seals through the cap second member fluid passages; and a pressure transmitter having a cylinder and a piston within the cylinder, the cylinder having a well fluid communication end, the well fluid communication end fluidically communicating with the second well fluid quantity such that the second well fluid quantity pressures the piston, the cylinder having a barrier fluid communication end, the barrier fluid communication end fluidically communicating with the housing second chamber, such that the barrier fluid pressurably engages the piston; the piston being sized such that the pressure from the second well fluid quantity on the piston is transmitted to the barrier fluid, the barrier fluid pressure opposing the first well fluid quantity pressure exerted by the first well fluid quantity on the packing assembly packing seal bottom.

In some exemplary embodiments barrier fluid pressure and the first well fluid quantity pressure are substantially balanced across the packing assembly packing seal.

In some exemplary embodiments the barrier fluid pressure is not less than the first well fluid quantity pressure, across the packing assembly packing seal.

In some exemplary embodiments the second well fluid quantity is routed from the housing first chamber to the pressure transmitter cylinder well fluid communication end.

In some exemplary embodiments the well has a flow line transporting produced well fluids, and further wherein the second well fluid quantity is routed from the well flow line to the pressure transmitter cylinder well fluid communication end.

In some exemplary embodiments the well has a casing, the well accumulating pressured gas in the casing, and further wherein the second well fluid quantity is routed from the casing to the pressure transmitter cylinder well fluid communication end.

In some exemplary embodiments the secondary packing arrangement further comprises a fitting for introducing a fluid into the third chamber.

In some exemplary embodiments the secondary packing arrangement further comprises a wick material positioned about the polished rod in the third chamber, for absorbing the introduced fluid in the third chamber and applying the fluid to the polished rod.

In some exemplary embodiments the introduced fluid is the same as the barrier fluid.

In some exemplary embodiments the fitting is a grease fitting.

For a well producing at least first and second quantities of well fluids, and in combination with a reciprocating plunger type pump having a polished rod, and a stuffing box through which the polished rod moves, the stuffing box having a stuffing box packing seal, we have provided a secondary packing arrangement through which the polished rod moves, the secondary packing arrangement comprising: a housing having a top member and a chamber; a packing assembly, positioned within the housing chamber, through which the polished rod moves, the packing assembly having: a packing seal, having at least one packing seal element; a packing seal compression member positioned within the lower housing above the at least one packing seal element, the packing seal being positioned to divide the housing chamber into a first chamber and a second chamber, the first chamber containing the first well fluid quantity, the second chamber in fluidic communication with the stuffing box packing seal, such that the first well fluid quantity pressures, the packing seal; and a compression member displacement mechanism for forcing the packing seal compression member toward the packing seal and compressing the packing seal; a barrier fluid in the housing second chamber, the barrier fluid pressurably engaging the packing assembly; and a pressure transmitter having a cylinder and a piston within the cylinder, the cylinder having a well fluid communication end, the well fluid communication end fluidically communicating with the second well fluid quantity such that the second well fluid quantity pressures the piston, the cylinder having a barrier fluid communication end, the barrier fluid communication end fluidically communicating with the housing second chamber, such that the barrier fluid pressurably engages the piston; the piston being sized such that the pressure from the second well fluid quantity on the piston is transmitted to the barrier fluid, the barrier fluid pressure opposing the first well fluid quantity pressure exerted by the first well fluid quantity on the packing assembly packing seal. In some exemplary embodiments the barrier fluid pressure and the first well fluid quantity pressure are substantially balanced across the packing assembly packing seal.

In some exemplary embodiments the barrier fluid pressure is not less than the first well fluid quantity pressure, across the packing assembly packing seal.

In some exemplary embodiments the second well fluid quantity is routed from the housing first chamber to the pressure transmitter cylinder well fluid communication end.

In some exemplary embodiments the well has a flow line transporting produced well fluids, and further wherein the second well fluid quantity is routed from the well flow line to the pressure transmitter cylinder well fluid communication end.

In some exemplary embodiments the well has a casing, the well accumulating pressured gas in the casing, and further wherein the second well fluid quantity is routed from the casing to the pressure transmitter cylinder well fluid communication end.

In some exemplary embodiments the compression member displacement mechanism extends through the housing top member.

For a well producing at least first and second quantities of well fluids, and in combination with a reciprocating plunger type pump having a polished rod, and a stuffing box through which the polished rod moves, we have provided a secondary packing arrangement through which the polished rod moves, the secondary packing arrangement comprising: the stuffing box, the stuffing box having: a top member and a lower housing forming a chamber; an upper packing seal positioned within the top member; a lower packing seal, the upper and lower packing seals each having at least one packing seal element; a lower packing seal compression member, the lower packing seal and compression member being positioned within the lower housing such that the lower packing seal divides the chamber into a first and second chamber, the first containing the first well fluid quantity, the second chamber in fluidic communication with the upper packing seal, such that the first well fluid quantity pressures the lower packing seal; and a compression member displacement mechanism for forcing the packing seal compression member toward the lower packing seal and compressing the lower packing seal; a barrier fluid in the housing second chamber between the upper packing seal and the lower packing seal, the barrier fluid pressurably engaging the lower packing seal; and a pressure transmitter having a cylinder and a piston within the cylinder, the cylinder having a well fluid communication end, the well fluid communication end fluidically communicating with the second well fluid quantity such that the second well fluid quantity pressures the piston, the cylinder having a barrier fluid communication end, the barrier fluid communication end fluidically communicating with the housing second chamber, such that the barrier fluid pressurably engages the piston; the piston being sized such that the pressure from the second well fluid quantity on the piston is transmitted to the barrier fluid, the barrier fluid pressure opposing the first well fluid quantity pressure exerted by the first well fluid quantity on the lower packing seal.

In some exemplary embodiments the barrier fluid pressure and the first well fluid quantity pressure are substantially balanced across the packing assembly packing seal.

In some exemplary embodiments the barrier fluid pressure is not less than the first well fluid quantity pressure, across the packing assembly packing seal.

In some exemplary embodiments the second well fluid quantity is routed from the housing first chamber to the pressure transmitter cylinder well fluid communication end.

In some exemplary embodiments the well has a flow line transporting produced well fluids, and further wherein the second well fluid quantity is routed from the well flow line to the pressure transmitter cylinder well fluid communication end.

In some exemplary embodiments the well has a casing, the well accumulating pressured gas in the casing, and further wherein the second well fluid quantity is routed from the casing to the pressure transmitter cylinder well fluid communication end.

In some exemplary embodiments the compression member displacement mechanism extends through the housing top member.

For a well producing at least first and second quantities of well fluids, and in combination with a reciprocating plunger type pump having a polished rod, and a stuffing box through which the polished rod moves, the stuffing box having a stuffing box packing seal, we have provided a secondary packing arrangement, through which the polished rod moves, the secondary packing arrangement, comprising: a housing having a top member and a chamber; a packing assembly, positioned within the housing chamber, through which the polished rod moves, the packing assembly further comprising means for dividing the housing chamber into a first chamber and a second chamber, the first chamber containing the first well fluid quantity, the second chamber in fluidic communication with the stuffing box packing seal; a barrier fluid in the housing second chamber, and means for pressuring the barrier fluid such that the barrier fluid pressure on the packing assembly opposes the pressure exerted by the first well fluid quantity on the packing assembly.

In some exemplary embodiments, the secondary packing arrangement further comprises means for routing fluids from the housing first chamber for pressuring the barrier fluid.

In some exemplary embodiments the well has a flow line transporting well fluids, and the secondary packing arrangement further comprises means for routing fluids from the well flow line for pressuring the barrier fluid.

In some exemplary embodiments the well has a casing, the casing accumulating pressured hydrocarbon gas, and the secondary packing arrangement further comprises means for routing pressured gas from the well casing for pressuring the barrier fluid.

The foregoing features and advantages of our invention will be apparent from the following more particular descriptions of exemplary embodiments of the invention as illustrated, in some embodiments, in the accompanying drawings.

DETAILED DESCRIPTION OF EXEMPLARY EMBODIMENTS

The following discussion describes exemplary embodiments of the invention in detail. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
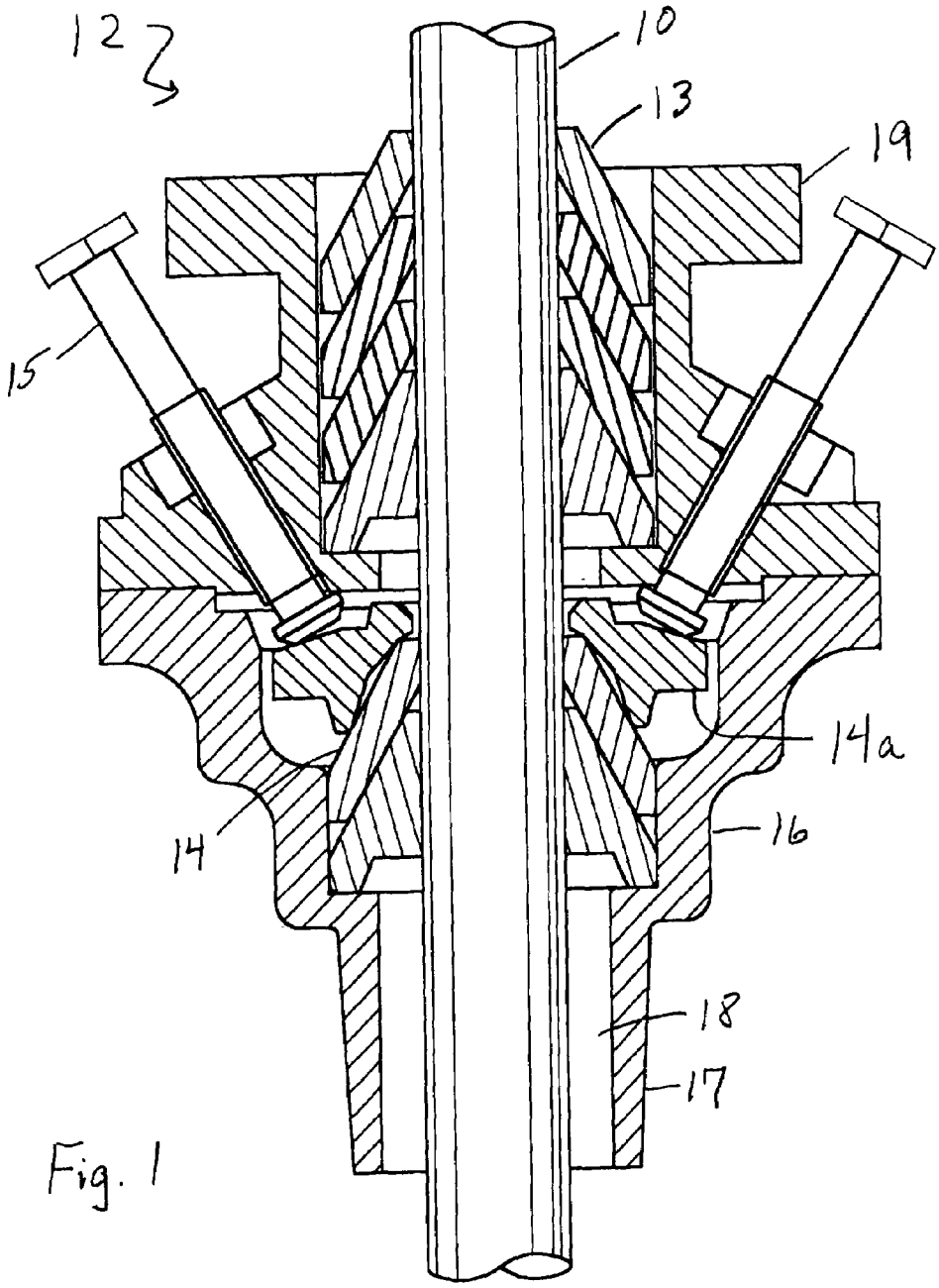
Fig. 1 Prior Art
FIG. 1 is a sectional view of a conventional double pack stuffing box.

Referring now to FIG. 1. A typical polished rod 10 extends from the well head and through a conventional double pack stuffing box 12. This stuffing box has two packing seal 13, 14 with each seal having at least two packing seal elements. The packing seal is commercially available and typically referred to as cone or dome packing. Tightening the bolts 15 presses the packing seal 14 against the polished rod by being turned against a packing seal compression ring 14*a*. The stuffing box has a lower housing 16 with a threaded end 17 for connecting to the well head, such that well fluids will enter the annulus 18 about the polished rod, from the well head fluid outlet below. The stuffing box also has an upper housing 19, encompassing the packing seal 13. A typical well will have a flow line leading from the well head for transporting well fluids, the well fluids typically including oil, salt water, and/or hydrocarbon gas. Such a flow line is in fluid communication with the well head fluid outlet to which the stuffing box is attached. Furthermore, a typical well will have a casing, in which well fluids, in the form of hydrocarbon gas, are accumulated under pressure.

Figure 2:
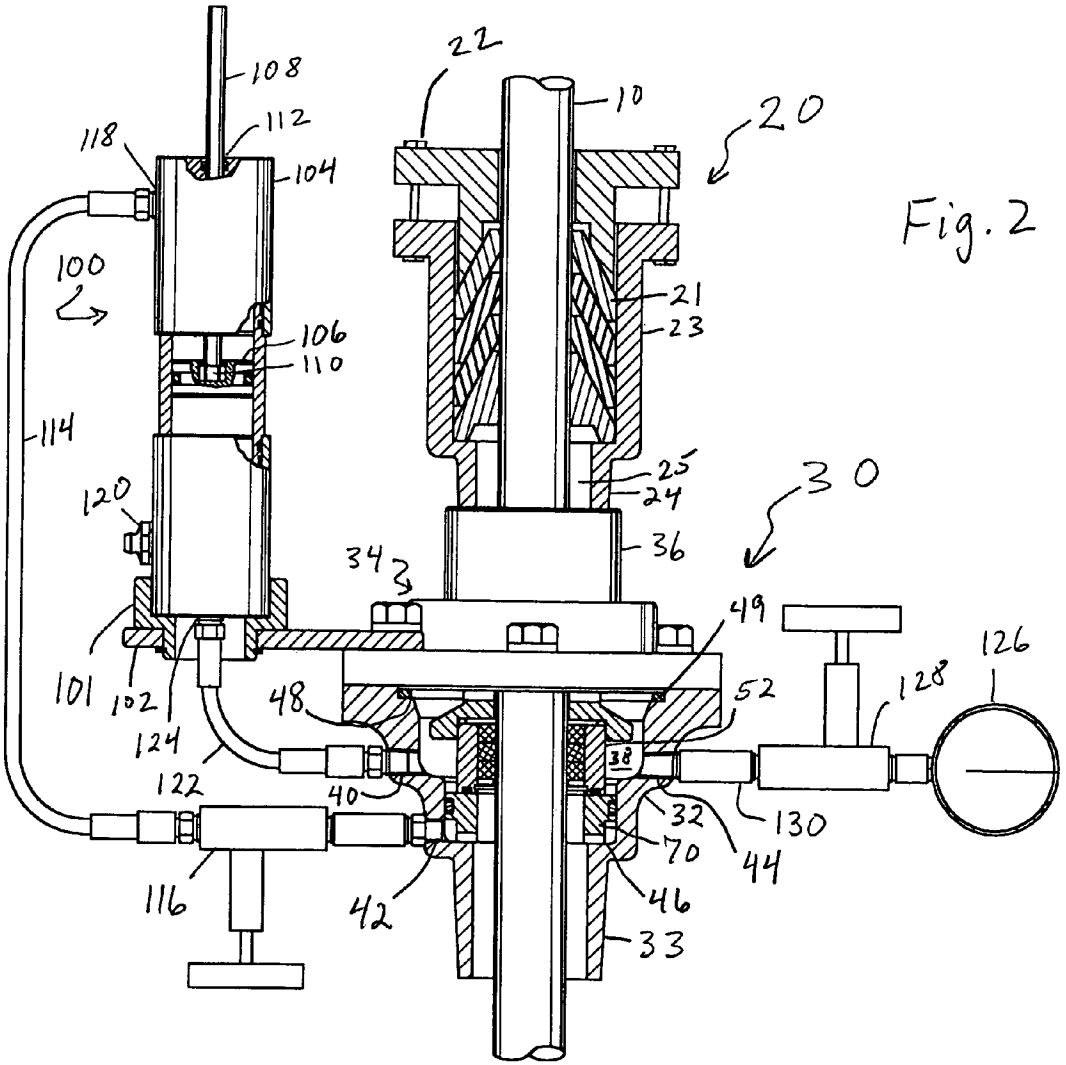
FIG. 2 is a partially sectional view of an exemplary embodiment of the present invention.

Referring now to FIG. 2, an exemplary embodiment of the secondary packing arrangement device 30 of the present invention is illustrated in combination with a conventional single pack stuffing box 20 having a packing seal 21 with four packing seal elements. In the conventional single pack stuffing box, when bolts 22 are tightened the packing seal is pressed against the polished rod 10. The stuffing box has a lower housing 23 with a threaded end 24 that, in a conventional installation, attaches to the well head such that an annulus 25 is formed about the polished rod.

Figure 3:
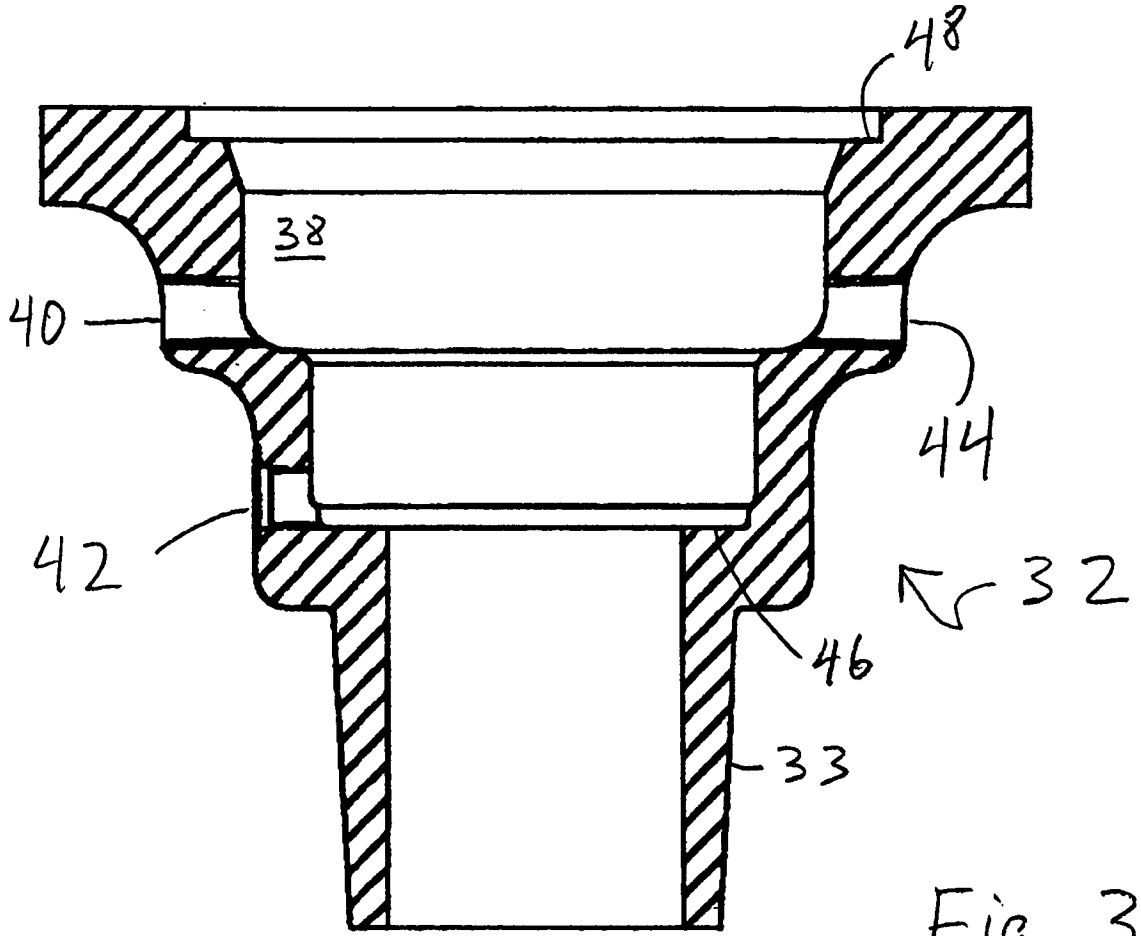
FIG. 3 is a sectional view of the lower housing in an exemplary embodiment of the present invention.
Figure 14:
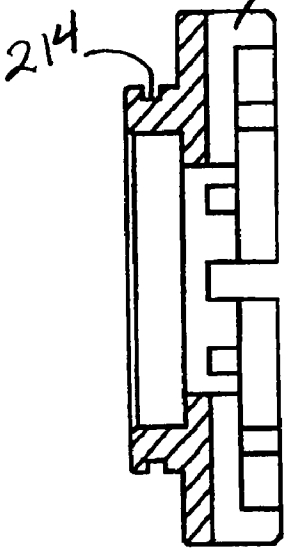
FIG. 14 is a sectional view of the packing assembly cap first member in FIG. 13.

In the exemplary embodiment shown in FIG. 2 and in a closer view in FIG. 14, the secondary packing arrangement 30 has a housing including a lower housing 32 that can readily be adapted from the lower housing 16 of the conventional double pack stuffing box shown in FIG. 1, with only slight resizing of the interior. The lower housing is shown in more detail in FIG. 3. The lower housing has a lower end 33 that threadably attaches to the wellhead at a well fluid outlet such that well fluids enter the lower housing. Bolted to the lower housing 32 is a top member 34 with an adapter 36 for threadably receiving the conventional single pack stuffing box lower housing end 24. The secondary packing arrangement housing forms a chamber 38 that is in fluid communication with the stuffing box packing seal 21. The lower housing 32 has three threaded outlets 40,42, 44, a first shoulder 46 and a second shoulder 48. The bolted joinder of the housing top member 34 to the lower housing 32 is sealed by a conventional O-ring 49 adjacent the second shoulder 48.

Figure 4:
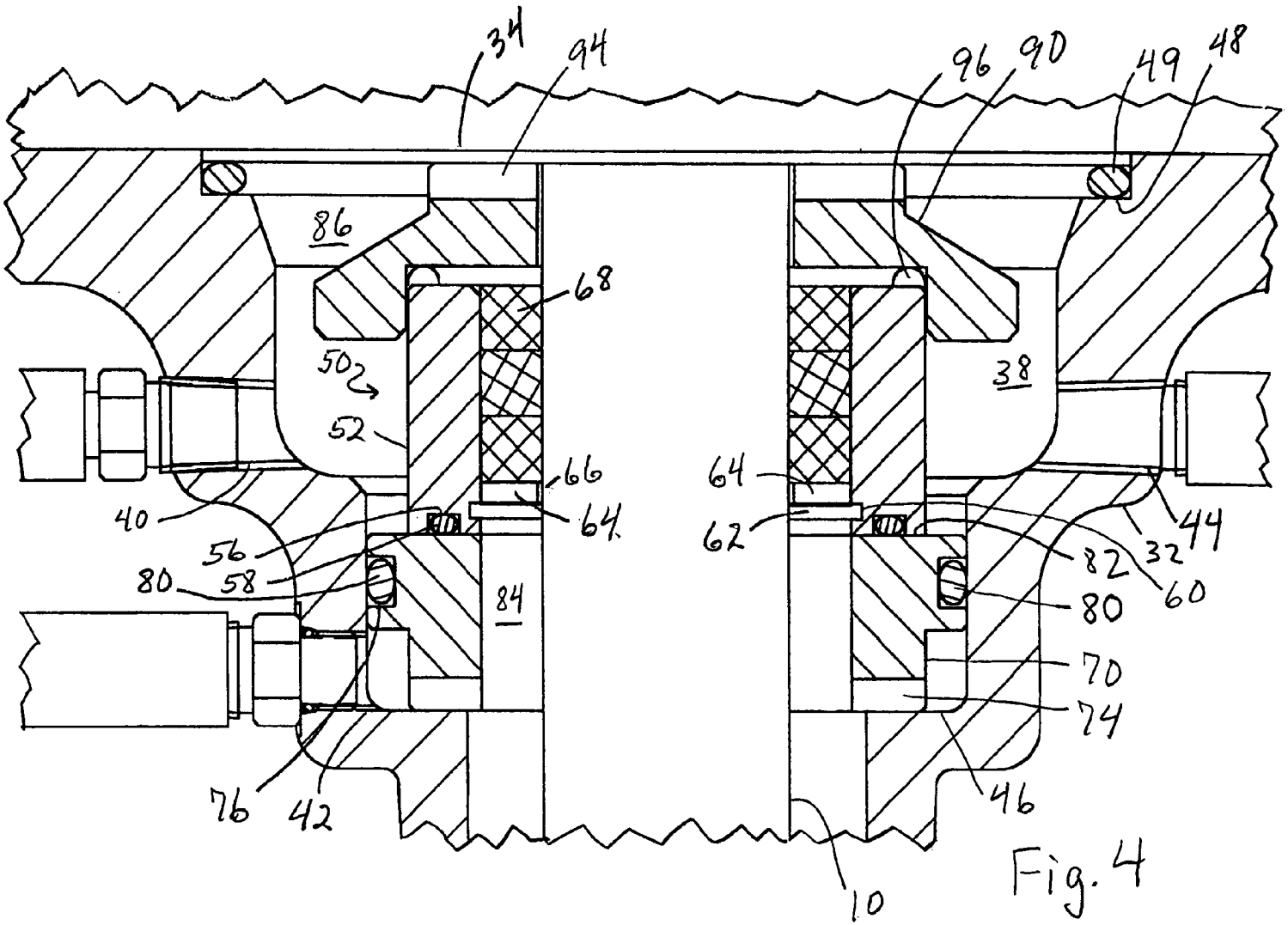
FIG. 4 is an enlargement of a portion of FIG. 2.
Figure 6:
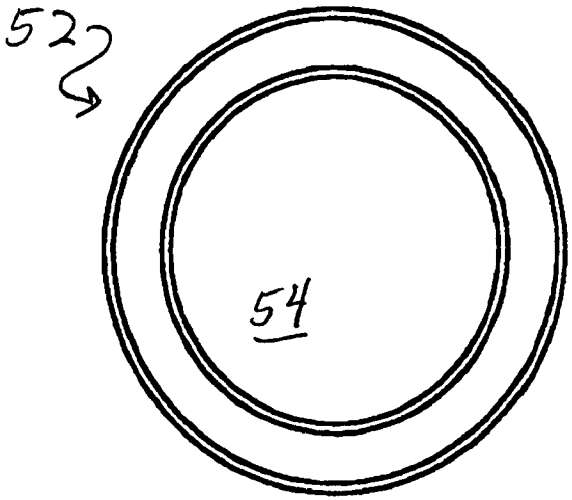
FIG. 6 is a top view of the packing assembly upper portion in FIG. 5.
Figure 5:
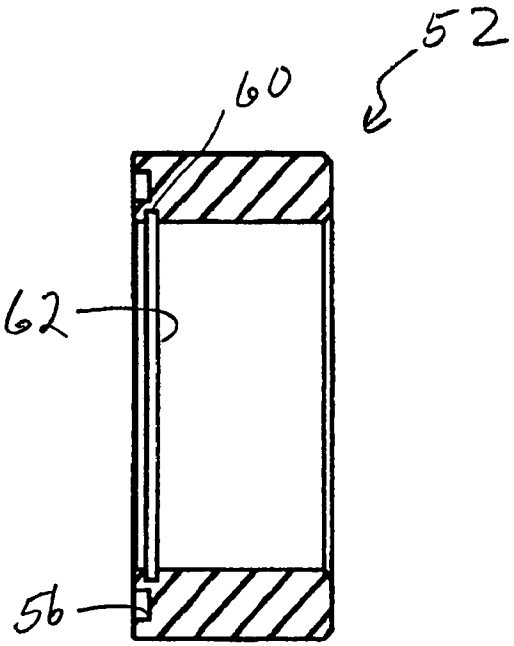
FIG. 5 is a sectional view of the packing assembly upper portion in an exemplary embodiment of the present invention.

As further illustrated in FIG. 2 and FIG. 4, this exemplary embodiment of the secondary packing arrangement 30 includes a packing assembly 50, positioned within the housing chamber 38, through which the polished rod 10 moves. In this exemplary embodiment, the packing assembly includes a cylinder having a top portion 52, shown in more detail in FIG. 5 and FIG. 6. As shown therein, the top portion is shown to have an open bottom 54, a groove 56 for accepting an O-ring 58, and a groove 60 for accepting a conventional snap ring 62. The snap ring supports a conventional washer 64, the washer sized to create a clearance 66 between the washer and the polished rod 10. The snap ring and washer retain a packing seal, which includes three conventional packing seal elements 68 positioned within the cylinder upper portion. These packing seal elements seal against the polished rod, preventing well fluid passage through the packing assembly cylinder upper portion.

Figure 8:
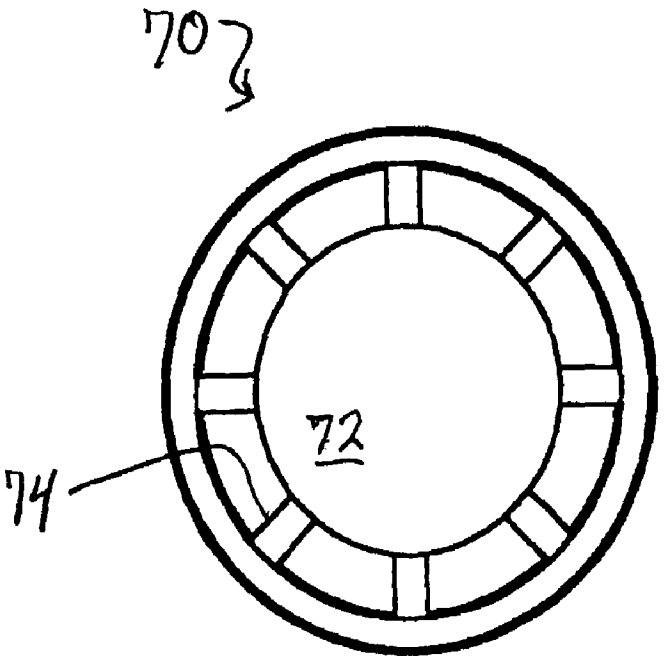
FIG. 8 is a bottom view of the packing assembly lower portion in FIG. 7.
Figure 7:
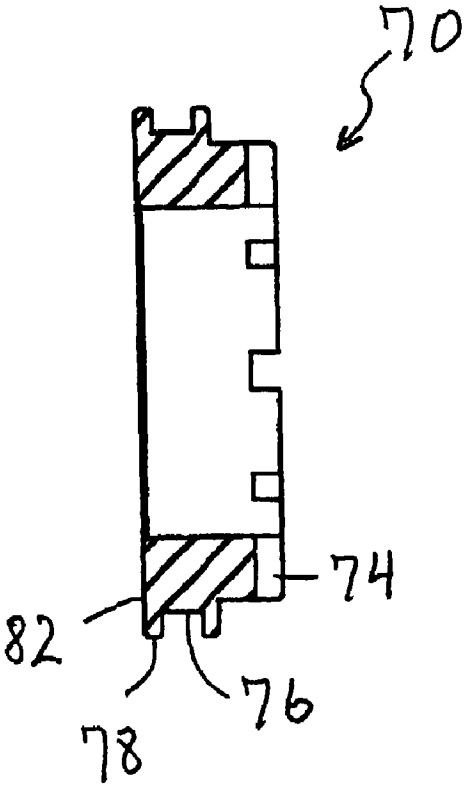
FIG. 7 is a sectional view of the packing assembly lower portion in an exemplary embodiment of the present invention.

In the exemplary embodiment illustrated in FIG. 4, the packing assembly cylinder also includes a bottom portion 70, shown in more detail in FIG. 7 and FIG. 8. The cylinder bottom portion has an opening 72, eight fluid passages 74, and a groove 76 in its outer wall 78 for positioning an O-ring 80 against the lower housing interior, thus sealing the annulus around the cylinder bottom portion 70 to prevent well fluids from passing to the annulus about the cylinder upper portion 52. The cylinder bottom portion also includes an upper surface 82 against which the cylinder upper portion 52 seals using the O-ring 58. These two seals, along with the seal between the polished rod and the packing seal elements 68, effectively divide the housing chamber 38 into a first chamber 84 and a second chamber 86, well fluids being present in the first chamber only.

Figure 10:
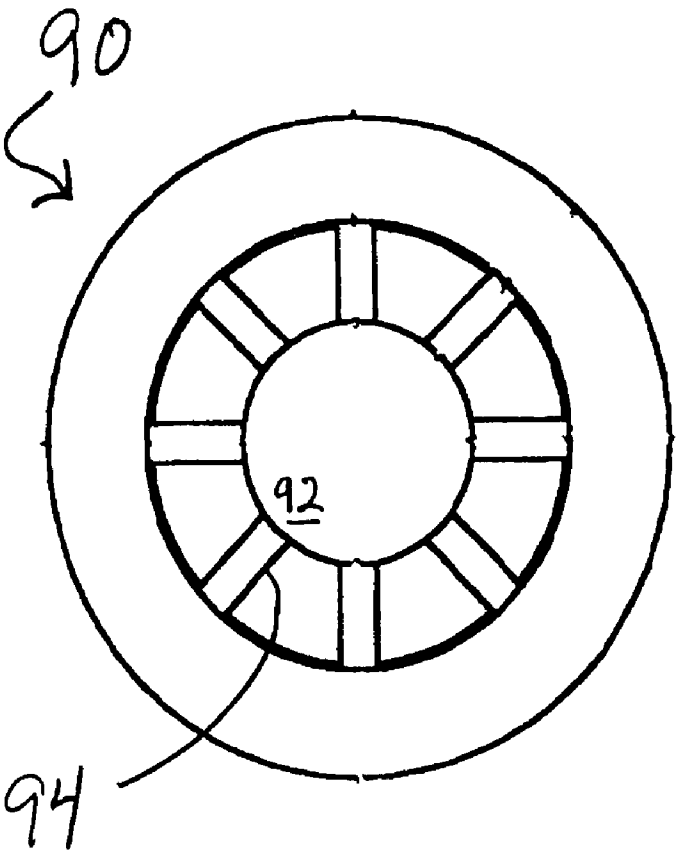
FIG. 10 is a top view of the packing assembly cap in FIG. 9.
Figure 9:
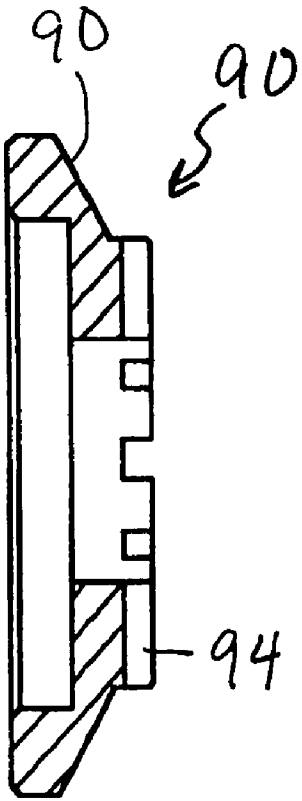
FIG. 9 is a sectional view of the packing assembly cap in an exemplary embodiment of the present invention.

In this exemplary embodiment of FIG. 2 and FIG. 4, the packing assembly 50 also includes a cap 90, shown in more detail in FIG. 9 and FIG. 10. The cap has an opening 92 and eight fluid passages 94. The cap fits on the top of the cylinder upper portion 52, and a conventional wave spring 96 is positioned between the cap and the cylinder upper portion. During installation of the secondary packing arrangement 30, the cap and the cylinder upper portion are free to simultaneously move along the top surface of the cylinder bottom portion 70 without breaking the seal between the cylinder upper and bottom portions. This allows optimum positioning of the packing seal elements 68 with respect to the polished rod 10. The housing top portion bears upon the cap as it is tightened, compressing wave spring 96, thereby loading O-ring 58 and maintaining a seal between cylinder upper and bottom portions.

In the exemplary embodiment of the present invention depicted in FIG. 2 and FIG. 4, the second chamber 86 is filled with a barrier fluid, which moves in the second chamber and through the cap 90 fluid passages 94 such that the barrier fluid contacts the packing seal, and any pressure within the second chamber acts on the packing seal elements.

A pressure transmitter 100 is provided in the exemplary embodiment of the present invention shown in FIG. 2. The transmitter sits in a base 101 that is attached to the housing top portion 34 using a bracket 102. The transmitter includes a cylinder 104 and a piston 106 within the cylinder. Attached to the piston is a rod 108 that screws into a nut 110 mounted in the piston. The rod extends from the cylinder through hole 112 with an elastomer seal. A hose 114 with a valve 116 extends from one of the lower housing outlets in the housing first chamber 84, and enters a well fluid communication end of the cylinder through inlet 118, establishing communication of well fluids and well fluids pressure from the well fluid outlet, through the housing first chamber, into the cylinder, and to the top of the piston. During installation the grease fitting 120 allows the operator to fill the housing second chamber 86 and the barrier fluid communication end of the cylinder below the piston with barrier fluid. A hose 122 extends from a cylinder barrier fluid communication end outlet 124 to one of the lower housing outlets 40, thus establishing barrier fluid communication between the housing second chamber and the cylinder below the piston.

In the exemplary embodiment illustrated in FIG. 2, the pressure transmitter piston 110 is sized such that the pressure from the well fluid on the piston is transmitted to the barrier fluid, resulting in the desired regulation of pressure across the packing assembly packing seal.

The rod 108 extruding from the cylinder 104 in the exemplary embodiment illustrated in FIG. 2 provides an indication as to the amount of barrier fluid. The greater the extended length, the more barrier fluid is present. In some exemplary embodiments, appropriate indicia are provided on the rod to provide information to the operator as to required addition of barrier fluid. In some exemplary embodiments, the rod is of sufficient size that it can be viewed by the operator from a distance.

In some exemplary embodiments, and as shown in FIG. 2, a pressure gauge 126, with valve 128 and related attachment fittings 130, is attached to the housing through one of the lower housing outlets 44, allowing the operator to determine the pressure in the housing second chamber 86, the pressure being then comparable by the operator to conventional well head pressure gauges (reflecting pressure in the housing first chamber 84) to confirm the proper regulation of pressure across the packing seal 50.

Figure 11:
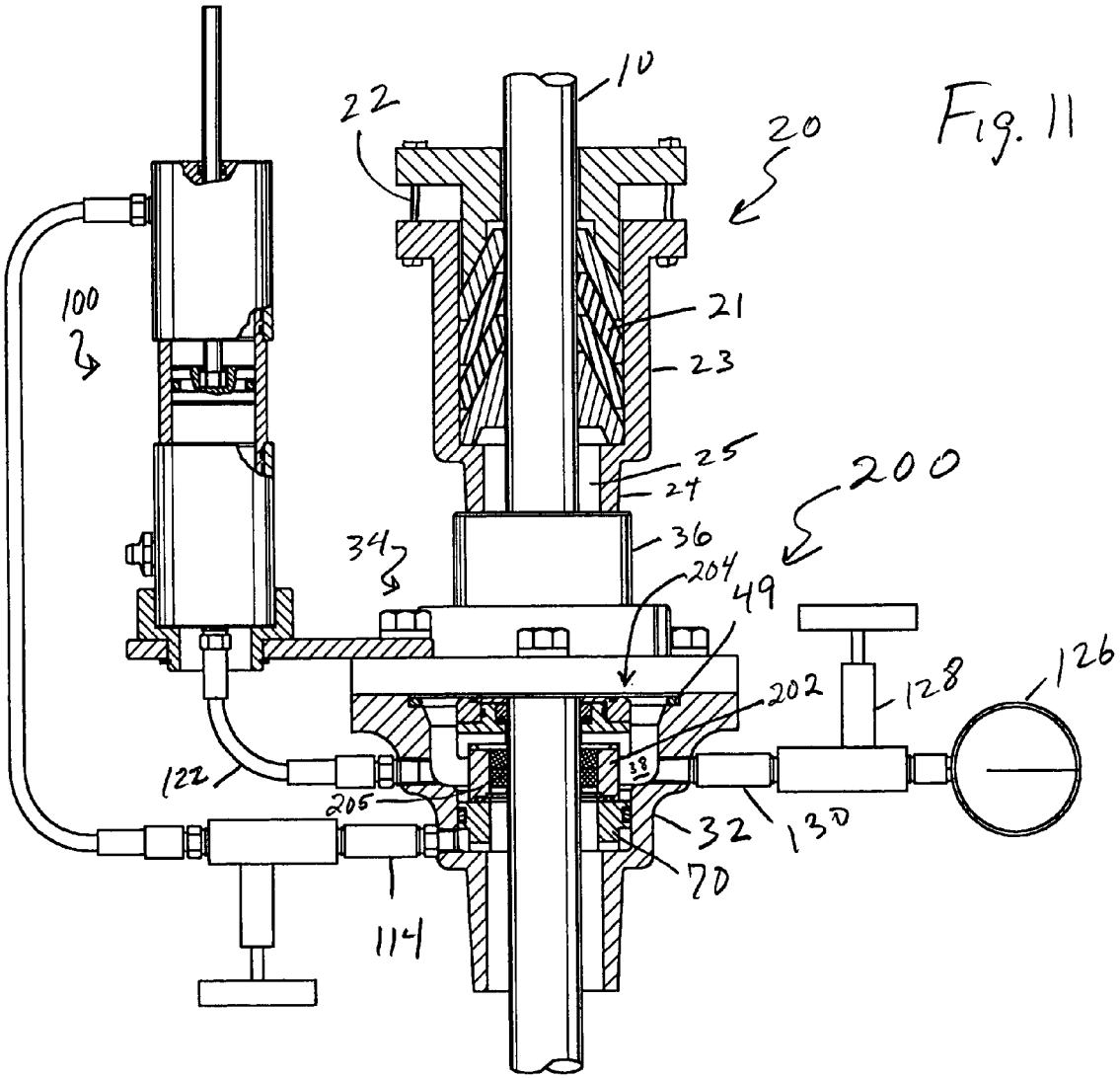
FIG. 11 is a partially sectional view of an exemplary embodiment of the present invention.
Figure 12:
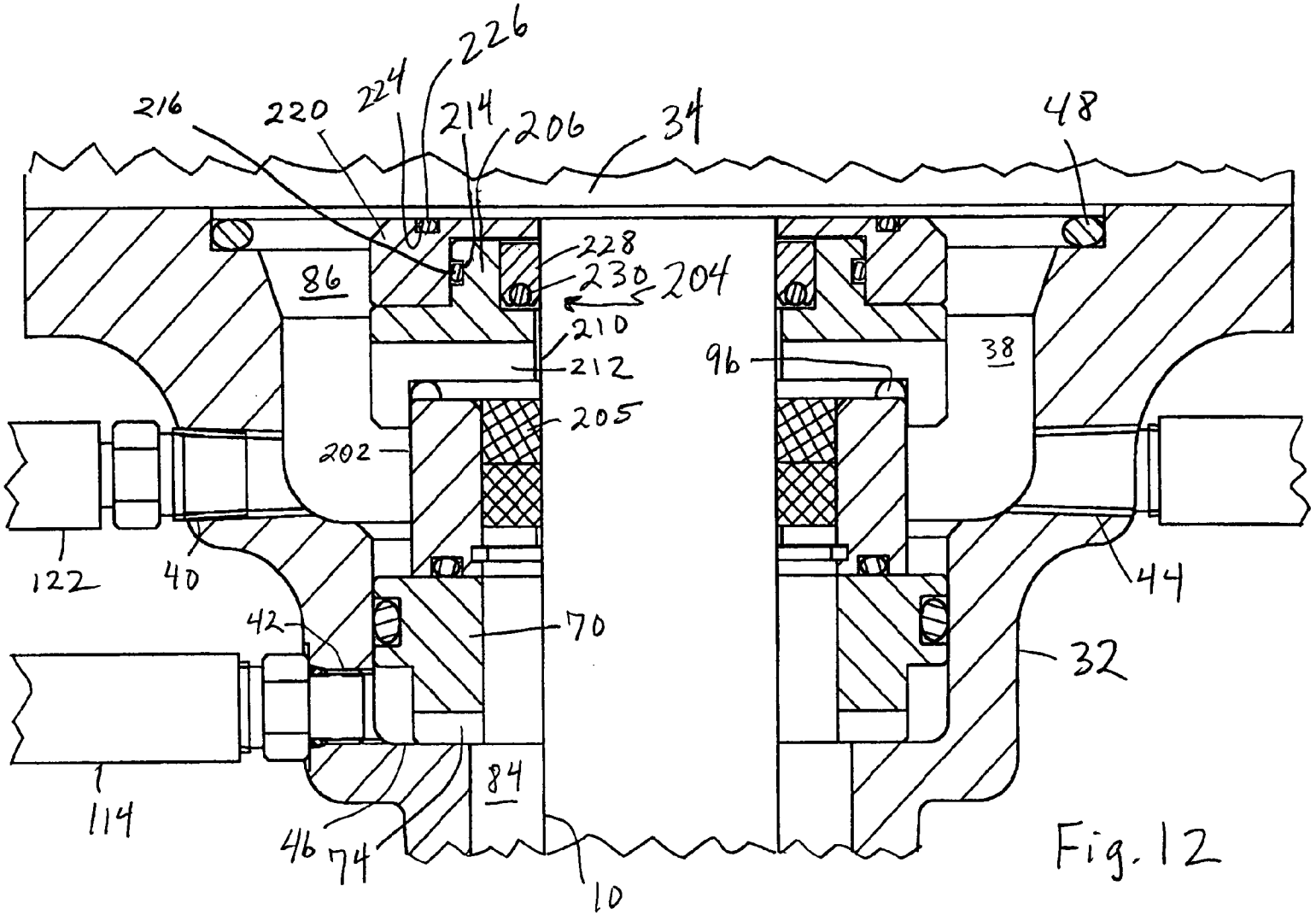
FIG. 12 is an enlargement of a portion of FIG. 11.

In another exemplary embodiment of the present invention, depicted in FIG. 11 and in more detail in FIG. 12, a different packing assembly cylinder upper portion 202 and cap 204 are provided. The cylinder upper portion 202 is reduced in height and encloses two packing seal elements 205. The snap ring 62 and the washer 64 are unchanged and support the packing seal elements as in the previously described exemplary embodiment. The cylinder upper portion 202 is free for sealed lateral movement and positioning during installation. Similarly, the packing assembly lower portion 70 seals against the housing to divide the housing into the first chamber 84 and the second chamber 86.

Figure 13:
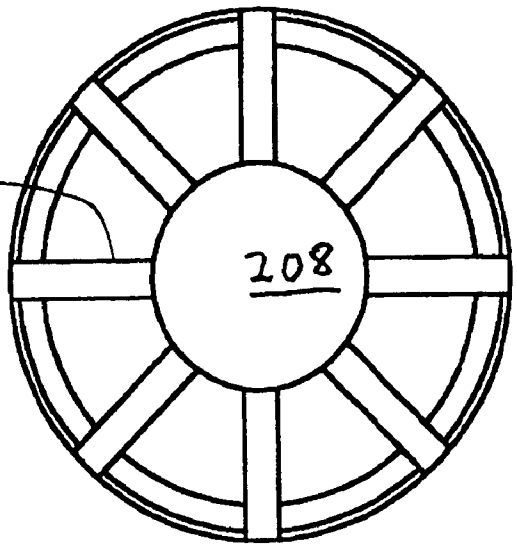
FIG. 13 is a bottom view of a packing assembly cap first member in an exemplary embodiment of the present invention.
Figure 16:
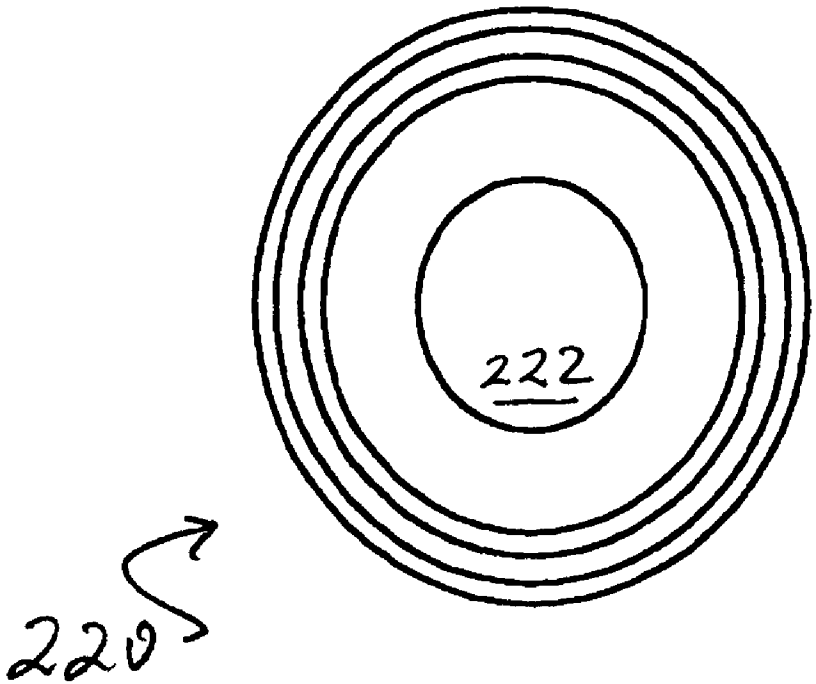
FIG. 16 is a top view of the packing assembly cap second member in FIG. 15.
Figure 15:
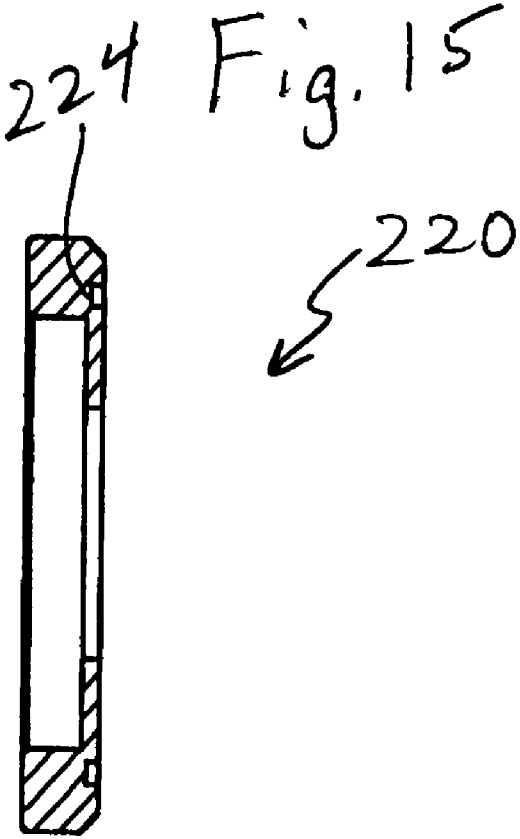
FIG. 15 is a sectional view of a packing assembly cap second member in an exemplary embodiment of the present invention.

In the exemplary embodiment shown in FIG. 12, the cap 204 includes a first member 206, shown in more detail in FIG. 13 and FIG. 14. The first member includes an opening 208 sized to create the clearance 210 between the first member opening and the polished rod 10. The first member has eight fluid passages 212 and a groove 214 for positioning an O-ring 216. The packing assembly cap second member 220, shown in more detail in FIG. 15 and FIG. 16, includes an opening 222 for the polished rod and a groove 224 for positioning an O-ring 226.

In this exemplary embodiment 200, the O-ring 216 seals the packing assembly cap first member 206 against the second member 220, and the O-ring 226 seals the second member against the housing top portion 34. The first and second members mate to form a space for positioning an intermediate packing seal member 228 about the polished rod, the intermediate packing seal member integrating an O-ring 230 for energizing the seal member against the polished rod 10. Unlike the cap 90 of the previous embodiment, the cap 204 in this exemplary embodiment does not have a fluid passage for allowing barrier fluid to contact the packing seal 21 of the conventional stuffing box 20. Instead, the cap 204 cooperates with the opening in the housing top member 34 to form a third chamber 232 between the cap second member, the intermediate packing seal member and the packing seal 21 of the stuffing box. The intermediate packing seal prevents barrier fluid from the second chamber from entering the third chamber. The intermediate packing seal load is automatically set upon installation and is not adjustable.

Figure 17:
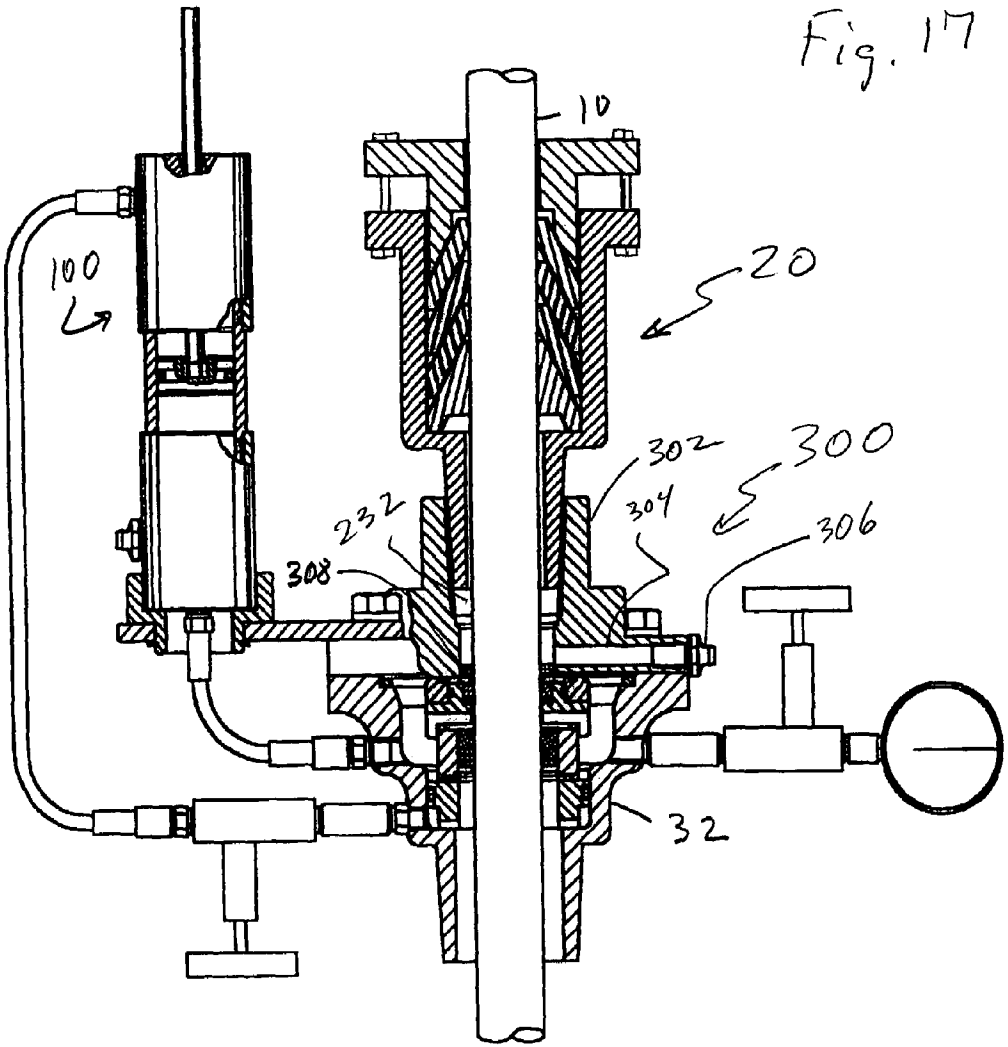
FIG. 17 is a partially sectional view of an exemplary embodiment of the present invention.
Figure 18:
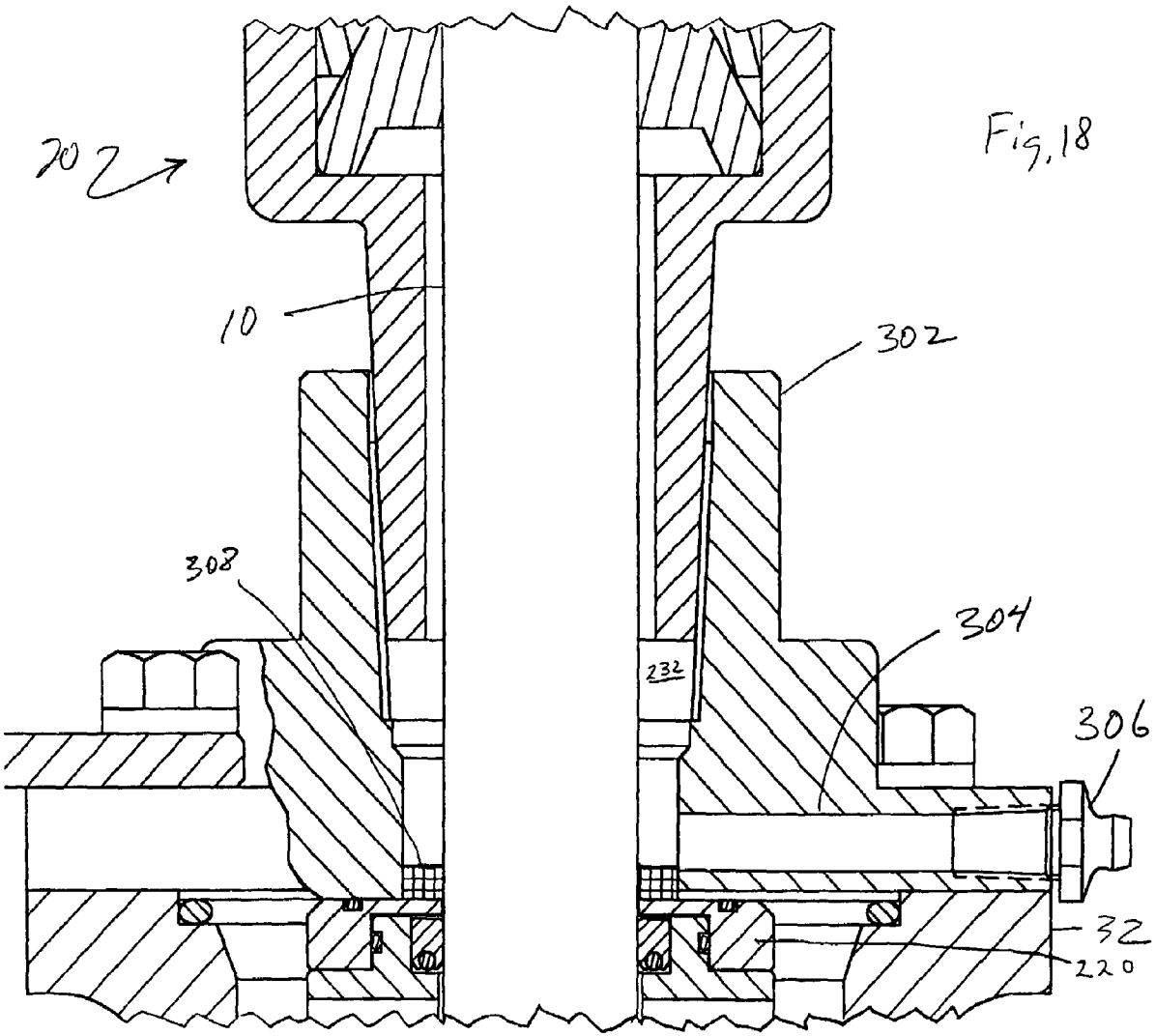
FIG. 18 is an enlargement of a portion of FIG. 17.

In another exemplary embodiment, of the type depicted in FIG. 17 and shown in more detail in FIG. 18, the housing top portion 302 is modified to include an outlet 304 from the third chamber 232, the outlet being adapted to receive a grease fitting 306. During installation the operator fills the third chamber with a barrier fluid, such as grease, and also positions a wick-type material about the polished rod 10 in the third chamber for soaking in the fluid and lubricating the polished rod.

Refer again to the exemplary embodiment depicted in FIG. 2 and FIG. 4, and the pressure transmitter 100, the hose 114, with valve 116, connected to inlet 118 on the well fluid communication end of the transmitter cylinder 104, the hose 122 connected to outlet 124 on the barrier fluid communication end of the transmitter cylinder 104, and the grease fitting 120. In another exemplary embodiment 30*a*, of the type depicted in FIG. 19, a hose 114*a* connects to outlet 124*a* on what is now the well fluid communication end of the transmitter 100*a* cylinder 104*a*, a hose 122*a* connects to inlet 118*a* on what is now the barrier fluid communication end of the transmitter cylinder 104*a*, and the grease fitting 120*a* is positioned on the barrier fluid communication end of the transmitter cylinder 104*a*. This reversal of hoses to the transmitter results in the barrier fluid, such as grease, being present in the top (barrier fluid communication end) of the transmitter where the seal about the indicator rod 108*a* is located at the hole 112 (see FIG. 2) in the transmitter cylinder 104*a*. Should this seal leak, the leaked fluid will be the relatively clean barrier fluid, instead of well fluids.

Similarly, refer again to the exemplary embodiment depicted in FIG. 11 and FIG. 12, having corresponding pressure transmitter components with the exemplary embodiment of FIG. 2, i.e. the pressure transmitter 100, the hose 114, with valve 116, connected to inlet 118 on the well fluid communication end of the transmitter cylinder 104, the hose 122 connected to outlet 124 on the barrier fluid communication end of the transmitter cylinder 104, and the grease fitting 120. In another exemplary embodiment 200*a*, of the type depicted in FIG. 20, a hose 114*a* connects to outlet 124*a* on what is now the well fluid communication end of the transmitter 100*a* cylinder 104*a*, a hose 122*a* connects to inlet 118*a* on what is now the barrier fluid end of the transmitter cylinder 104*a*, and the grease fitting 120*a* is positioned on the barrier fluid communication end of the transmitter cylinder 104*a*. This reversal of hoses to the transmitter results in the barrier fluid, such as grease, being present in the top (barrier fluid communication end) of the transmitter where the seal about the indicator rod 108*a* is located at the hole 112 (see FIG. 2) in the transmitter cylinder 104*a*. Again, should this seal leak, the leaked fluid will be the relatively clean barrier fluid, instead of well fluids.

Similarly, refer again to the exemplary embodiment depicted in FIG. 17 and FIG. 18, having corresponding pressure transmitter components with the exemplary embodiment of FIG. 2, i.e. the pressure transmitter 100, the hose 114, with valve 116, connected to inlet 118 on the well fluid communication end of the transmitter cylinder 104, the hose 122 connected to outlet 124 on the barrier fluid communication end of the transmitter cylinder 104, and the grease fitting 120. In another exemplary embodiment 300*a*, of the type depicted in FIG. 21, a hose 114*a* connects to outlet 124*a* on what is now the well fluid communication end of the transmitter 100*a* cylinder 104*a*, a hose 122*a* connects to inlet 118*a* on what is now the barrier fluid communication end of the transmitter cylinder 104*a*, and the grease fitting 120*a* is positioned on the barrier fluid communication end of the transmitter cylinder 104*a*. This reversal of hoses to the transmitter results in the barrier fluid, such as grease, being present in the top (barrier fluid communication end) of the transmitter where the seal about the indicator rod 108*a* is located at the hole 112 (see FIG. 2) in the transmitter cylinder 104*a*. Again, should this seal leak, the leaked fluid will be the relatively clean barrier fluid, instead of well fluids.

Figure 19:
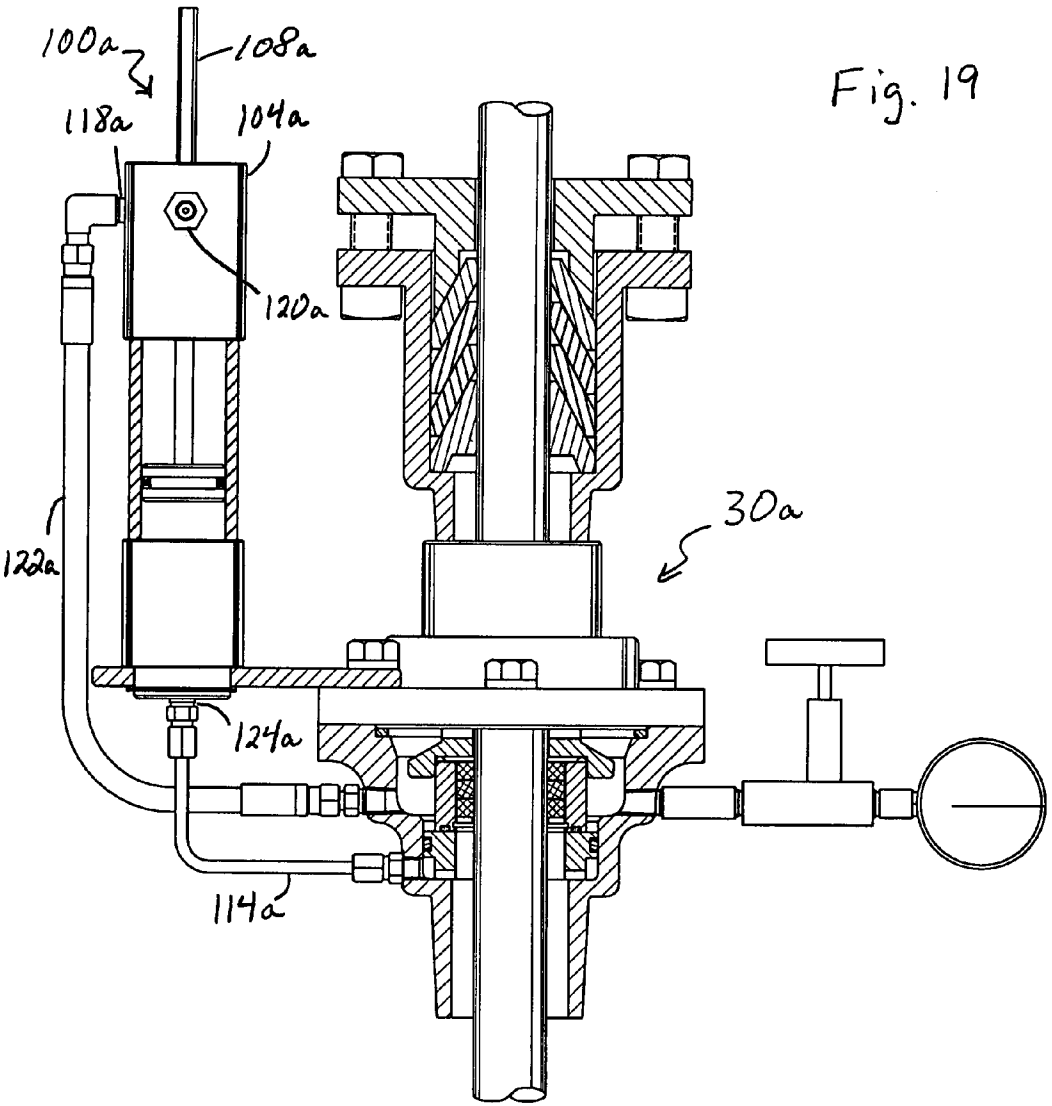
FIG. 19 is a partially sectional view of an exemplary embodiment of the present invention.
Figure 20:
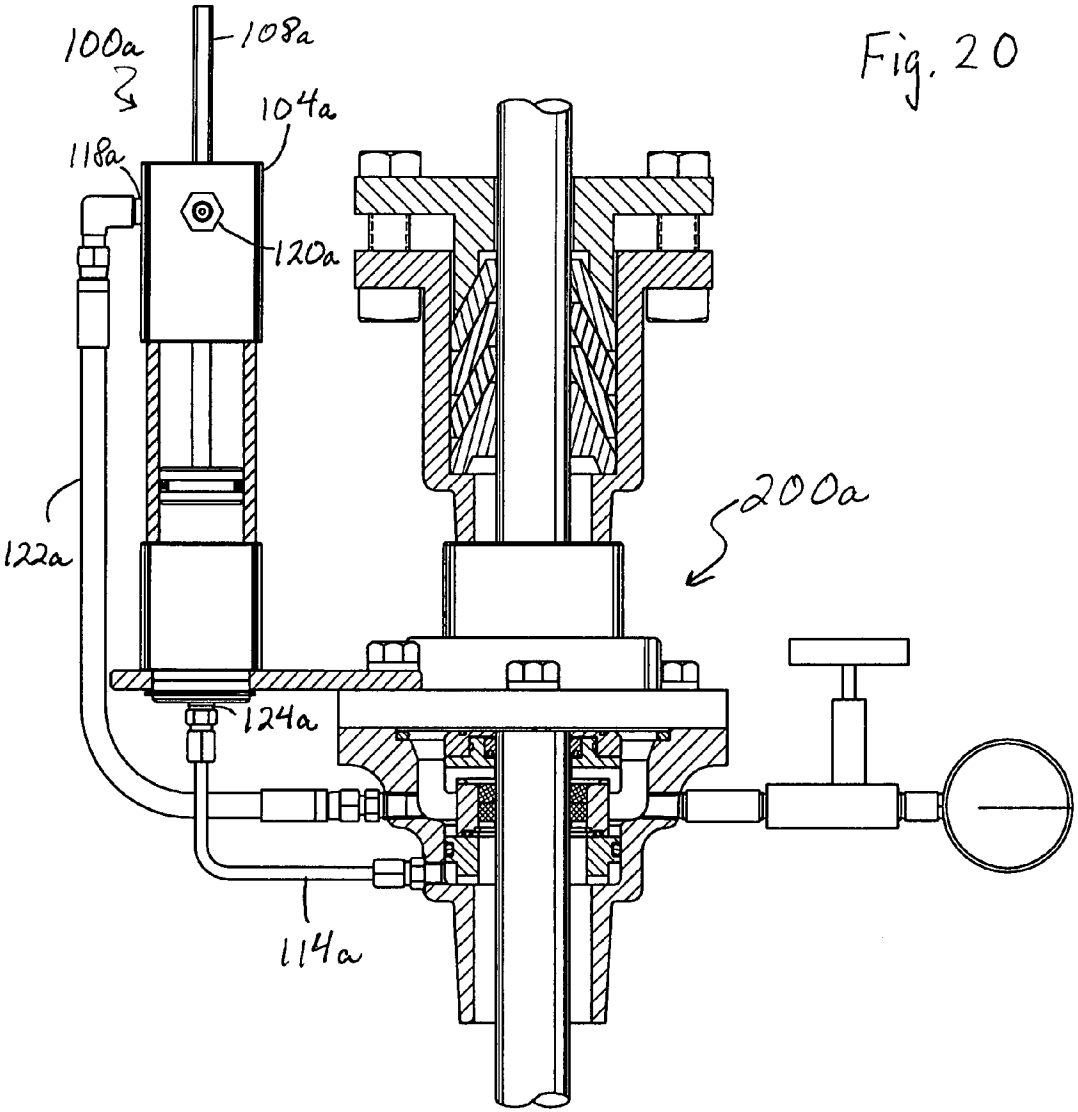
FIG. 20 is a partially sectional view of an exemplary embodiment of the present invention.
Figure 21:
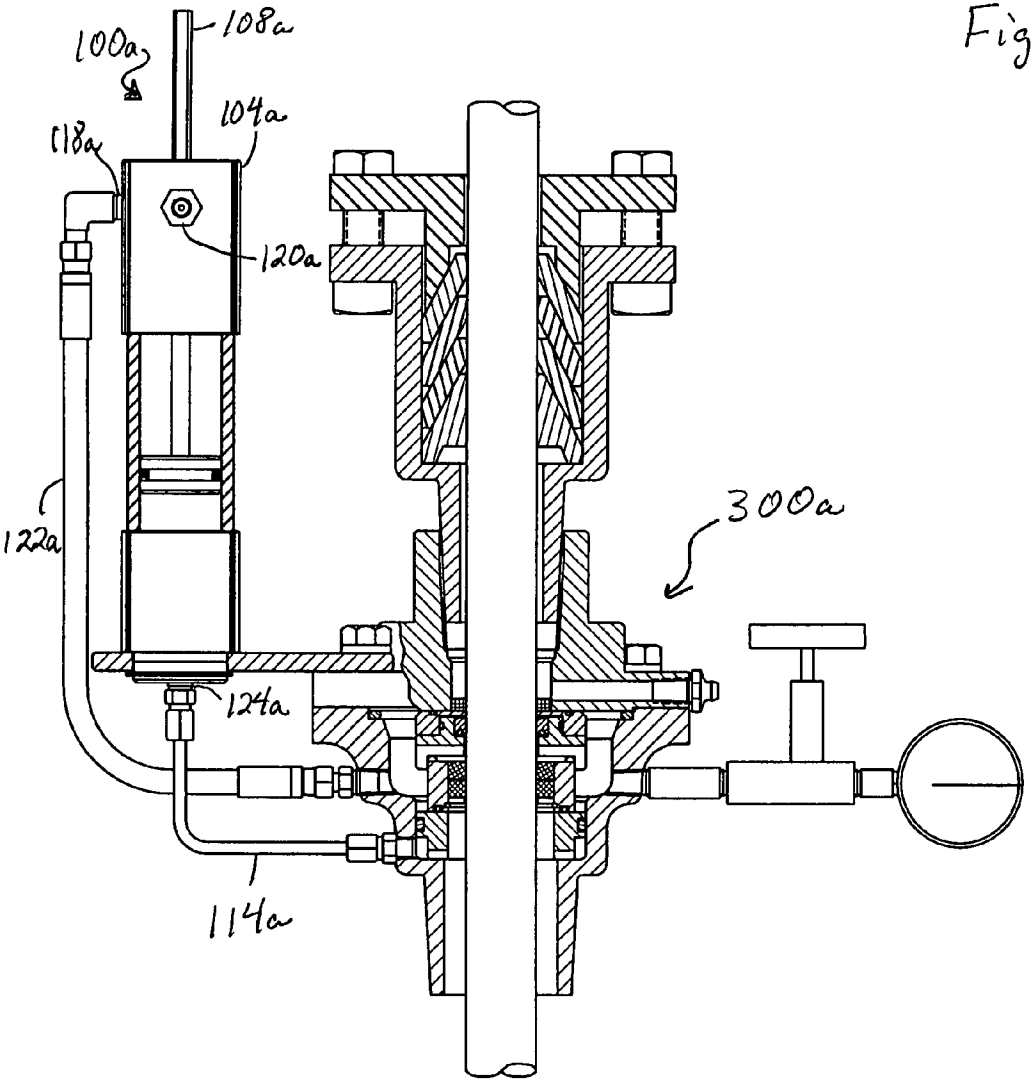
FIG. 21 is a partially sectional view of an exemplary embodiment of the present invention.

In exemplary embodiments of the type depicted in FIGS. 19-21, the reversal of the hoses 114*a*, 122*a* results in barrier fluid being in the end of the pressure transmitter cylinder 104 through which the indicator rod 108*a* extends. As a result, a decrease in the amount of barrier fluid causes the indicator rod to extend further from the cylinder.

Figure 22:
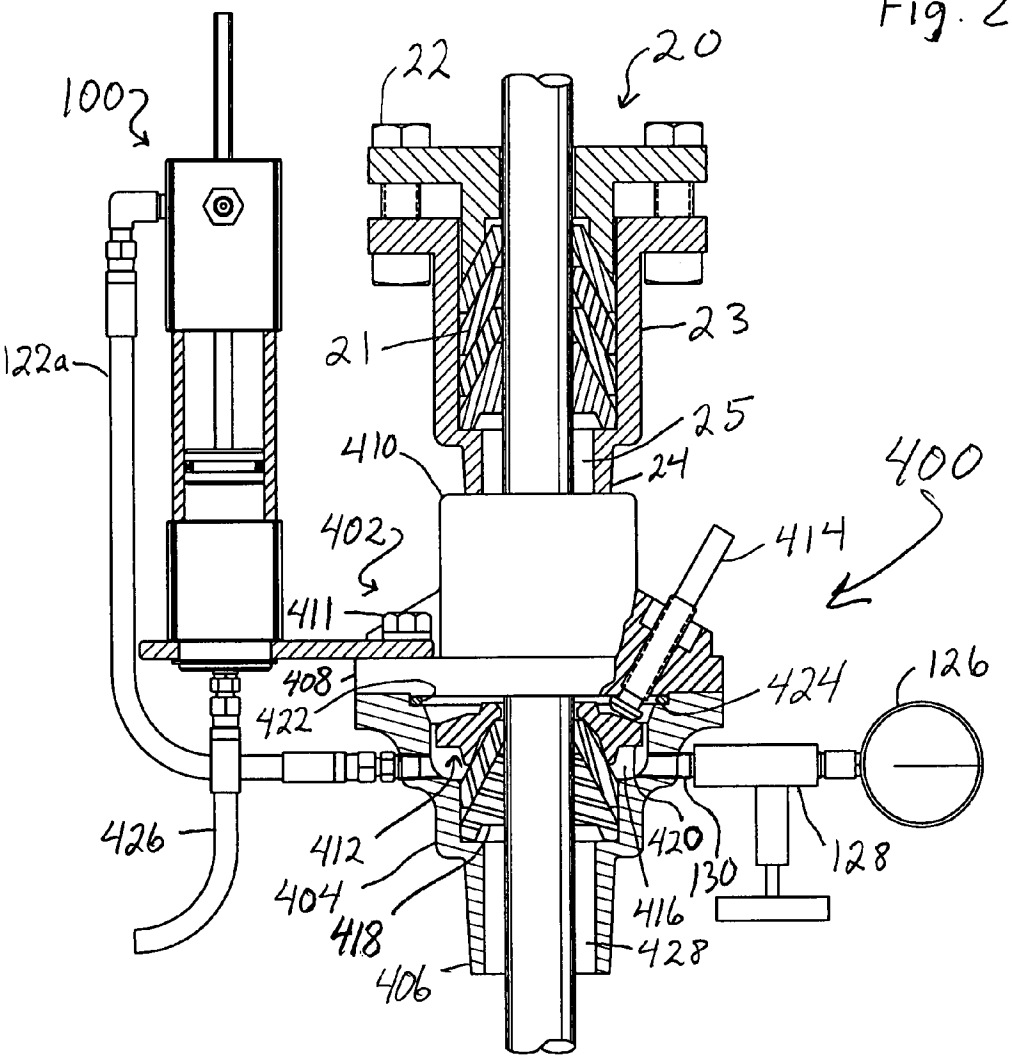
FIG. 22 is a partially sectional view of an exemplary embodiment of the present invention.

Turning to FIG. 22, an additional exemplary embodiment of a secondary packing arrangement 400 is illustrated in combination with a conventional single pack stuffing box 20 having a packing seal 21 with four packing seal elements. In the conventional single pack stuffing box, when bolts 22 are tightened the packing seal is pressed against the polished rod 10. The stuffing box has a lower housing 23 with a threaded end 24 that, in a conventional installation, attaches to the well head such that an annulus 25 is formed about the polished rod.

Figure 23:
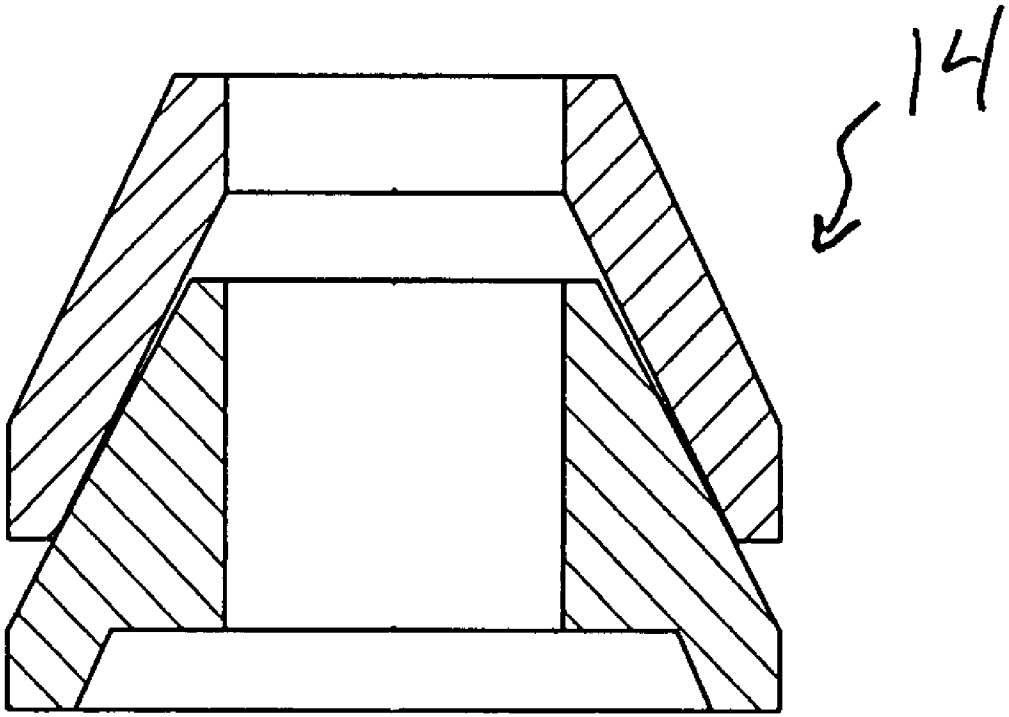
FIG. 23 is a sectional view of a conventional double pack stuffing box packing seal.
Figure 24:
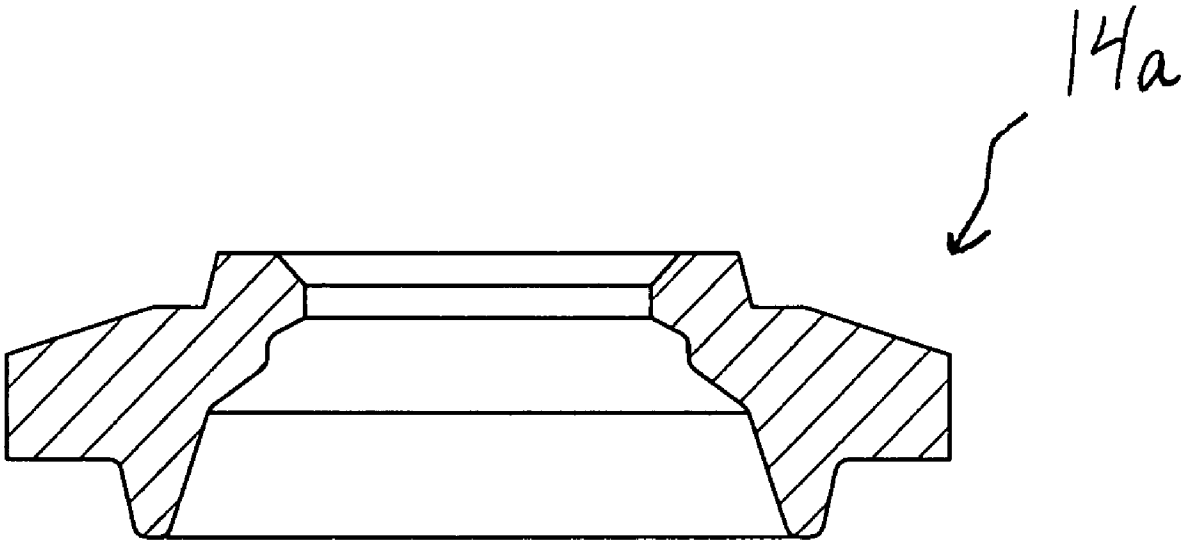
FIG. 24 is a sectional view of a conventional double pack stuffing box compression ring.

In exemplary embodiments of the type shown in FIG. 22, the secondary packing arrangement 400 has a housing 402 including a lower housing 404 that can readily be adapted from the lower housing 16 of the conventional double pack stuffing box shown in FIG. 1, with only slight modification. The lower housing 404 has a lower end 406 that threadably attaches to the wellhead at a well fluid outlet such that well fluids enter the lower housing. Bolted to the lower housing 404 is an upper housing 408 with an adapter 410 for threadably receiving the conventional single pack stuffing box lower housing end 24. Bolts 411 (one shown) are provided for bolting the upper housing 408 to the lower housing 404. As part of a packing assembly 412, two bolts 414 (one shown) are positioned by the upper housing 408 in a manner similar to the two bolts 15 shown in the conventional double pack stuffing box 12 depicted in FIG. 1. The housing 402 forms a chamber 416, and within the housing chamber, and as part of the packing assembly 412, is a packing seal 418 and a packing seal compression ring 420. The packing seal and compression ring 418,420 are, in some exemplary embodiments, the same as the packing seal 14 and compression ring 14*a*, shown in FIG. 1. Additional, sectional views of the packing seal 14 and the compression ring 14*a*, are provided in FIG. 23 and FIG. 24, respectively.

In exemplary embodiments of the type illustrated in FIG. 22, the bolts 414 turn against the compression ring 420 forcing the packing seal 418 to seal against the polished rod 10. The bolted joinder of the upper housing 408 to the lower housing 404 is sealed by a conventional O-ring 422 positioned on a shoulder 424 of the lower housing. Although the upper housing 408 positions bolts 414 in a manner similar to the positioning of bolts 15 in the upper housing 19 of the conventional double pack stuffing box 12, the upper housing 408 no longer is configured to contain a packing seal such as the packing seal 13 positioned with the upper housing of the conventional stuffing box.

Refer again to the FIG. 19 and the hoses 114*a*,122*a*. A hose 122*a* is provided in exemplary embodiments of the type illustrated in FIG. 22 and is similarly routed as the hose 122*a* in FIG. 19. However, in some such exemplary embodiments, a hose 426 communicates well fluids using a conventional connection to another well fluid outlet on a flow line (not shown), instead of routing such well fluids from the chamber 428 below the packing assembly 412, as was the manner utilized in the exemplary embodiment of FIG. 19, using the hose 114*a*. This configuration continues to use the pressure transmitter 100 to regulate the pressures between the well fluids and the barrier fluid on either side of the packing assembly 412.

Similarly, in some exemplary embodiments of the type illustrated in FIG. 22, the hose 426 communicates well fluids using a conventional connection to another well fluid outlet on the casing (not shown).

In some exemplary embodiments of the kind depicted in FIG. 22, a pressure gauge 126, valve 128, and related attachment fittings 130 are provided, in a similar fashion to the pressure gauge 126, valve 128, and related attachment fittings 130 depicted in FIG. 19.

Figure 25:
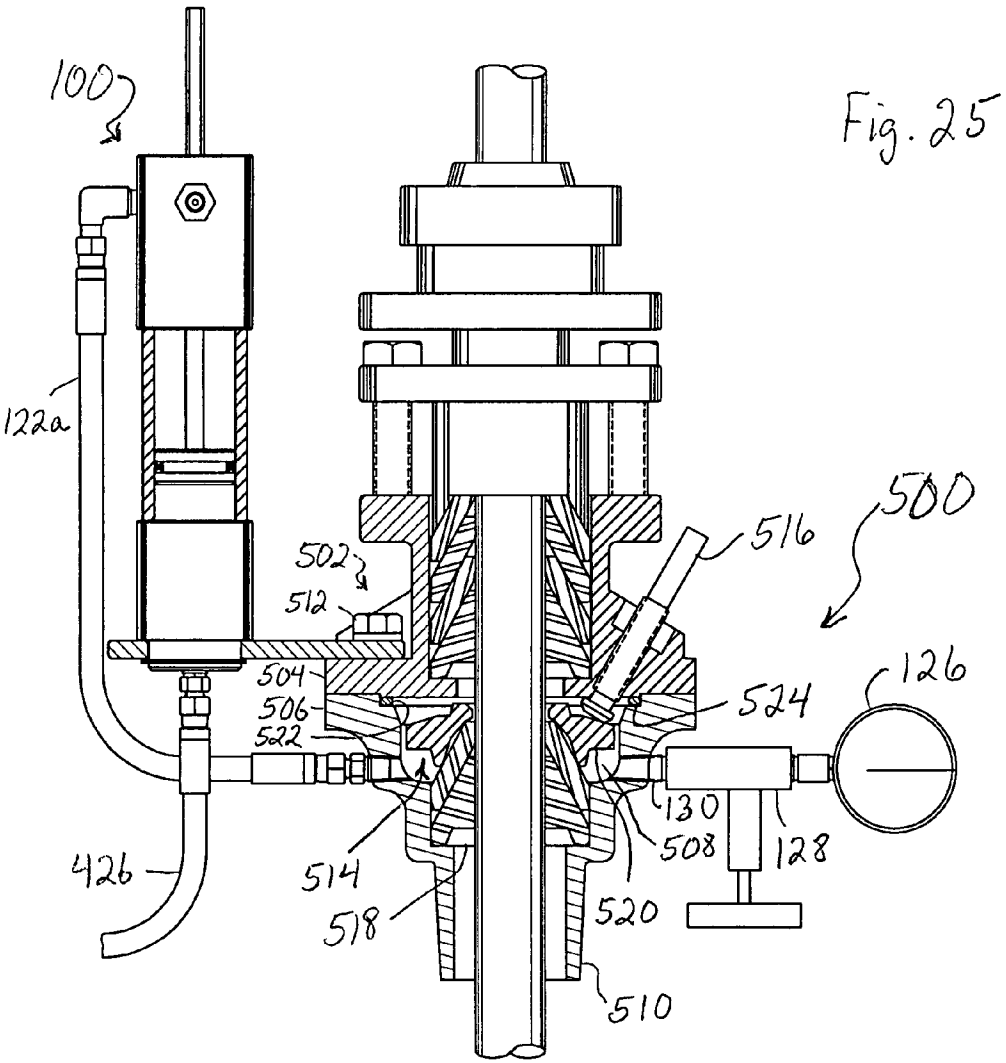
FIG. 25 is a partially sectional view of an exemplary embodiment of the present invention.

Turning now to FIG. 25, an exemplary embodiment of the secondary packing arrangement of the present invention is depicted, and is shown in combination with a conventional double pack stuffing box 502 of the type depicted in FIG. 1. In exemplary embodiments of the type shown in FIG. 25, the device has a housing 502, the housing having an upper housing 504 and a lower housing 506, the lower housing forming a chamber 508. The lower housing 506 has a lower end 510 that threadably attaches to the wellhead at a well fluid outlet such that well fluids enter the lower housing. Bolts 512 (one shown) are provided for bolting the upper housing 504 to the lower housing 506. As part of a packing assembly 514, two bolts 516 (one shown) are positioned by the upper housing in a manner similar to the two bolts 15 shown in the conventional double pack stuffing box 12 depicted in FIG. 1. Within the housing chamber 508, and as part of the packing assembly 514, is a packing seal 518 and a packing seal compression ring 520. The packing seal and compression ring 518,520 are, in some exemplary embodiments, the same as the packing seal 14 and compression ring 14*a*, shown in FIG. 1.

In exemplary embodiments of the type illustrated in FIG. 25, the bolts 516 turn against the compression ring 520 forcing the packing seal 518 to seal against the polished rod 10. The bolted joinder of the upper housing 504 to the lower housing 506 is sealed by a conventional O-ring 522 positioned on a shoulder 524 of the lower housing. The upper housing 504 positions bolts 516 in a manner similar to the positioning of bolts 15 in the upper housing 19 of the conventional double pack stuffing box 12, and the upper housing 504 is configured to contain a packing seal such as the packing seal 13 positioned with the upper housing of the conventional stuffing box.

Refer again to the FIG. 19 and the hoses 114*a*,122*a*. A hose 122*a* is provided in exemplary embodiments of the type illustrated in FIG. 25 and is similarly routed as the hose 122*a* in FIG. 19. However, in some such exemplary embodiments, a hose 426 communicates well fluids using a conventional connection to another well fluid outlet on a flow line (not shown), instead of routing such well fluids from the chamber 508 below the packing assembly 514, as was the manner utilized in the exemplary embodiment of FIG. 19, using the hose 114*a*. This configuration continues to use the pressure transmitter 100 to balance the pressures exerted by the well fluids and the barrier fluid on either side of the packing assembly 514.

Similarly, in some exemplary embodiments of the type illustrated in FIG. 22, the hose 426 communicates well fluids using a conventional connection to another well fluid outlet on the casing (not shown).

In some exemplary embodiments of the kind depicted in FIG. 25, a pressure gauge 126, valve 128, and related attachment fittings 130 are provided, in a similar fashion to the pressure gauge 126, valve 128, and related attachment fittings 130 depicted in FIG. 19.

In some exemplary embodiments of the kind illustrated in FIG. 2, FIG. 11, FIG. 17, FIG. 19, FIG. 20, and FIG. 21, a quantity of well fluids is routed to the pressure transmitter cylinder well fluid communication end from a well fluid outlet on a well flow line or from a well fluid outlet on a well fluid outlet from the well casing, eliminating the need for the hose leading from the housing first chamber.

In some exemplary embodiments of the kind illustrated in FIG. 22 and FIG. 25, a quantity of well fluids is routed to the pressure transmitter cylinder well fluid communication end from the housing first chamber.

In some exemplary embodiments and applications of the present invention the barrier fluid is either hydrocarbon based, a hydrocarbon based grease, non-hydrocarbon based, vegetable based, or animal fat based. In some exemplary embodiments and applications, the well fluid includes hydrocarbons, oil, hydrocarbon gas, and/or water.

With respect to the above description then, it is to be realized that the optimum apparatus for a particular application, will include elastomer seals, piping, fittings, hoses, barrier fluids, and other seal materials, which will occur to those skilled in the art upon review of the present disclosure.

All equivalent relationships to those illustrated in the drawings and described in the specification are intended to be encompassed by the present invention.

The descriptions in this specification are for purposes of illustration only and are not to be construed in a limiting sense. The scope of the present invention is limited only by the language of the following claims.

We claim:

1. For a well producing at least first and second quantities of well fluids, and in combination with a reciprocating plunger type pump having a polished rod, and a stuffing box through which the polished rod moves, the stuffing box having a stuffing box packing seal, a secondary packing arrangement, through which the polished rod moves, the secondary packing arrangement, comprising:

a housing having a top member and a chamber;

a packing assembly, positioned within the housing chamber, through which the polished rod moves, the packing assembly having:

a cylinder, the cylinder having an outer wall sealed against the housing;

a packing seal, having at least one packing seal element, the packing seal having a top and a bottom, the packing seal and the cylinder dividing the housing chamber into a first chamber and a second chamber, the first chamber containing the first well fluid quantity, the second chamber in fluidic communication with the stuffing box packing seal;

a retaining member supporting the packing seal, such that the first well fluid pressures the packing seal bottom; and a cap on the cylinder, the cap having fluid passages;

a barrier fluid in the housing second chamber, the barrier fluid pressurably engaging the packing seal top through the cap fluid passages; and a pressure transmitter having a cylinder and a piston within the cylinder, the cylinder having a well fluid communication end, the well fluid communication end fluidically communicating with the second well fluid quantity such that the second well fluid quantity pressures the piston, the cylinder having a barrier fluid communication end, the barrier fluid communication end fluidically communicating with the housing second chamber, such that the barrier fluid pressurably engages the piston;

the piston being sized such that the pressure from the second well fluid quantity on the piston is transmitted to the barrier fluid, the barrier fluid pressure opposing the first well fluid quantity pressure exerted by the first well fluid quantity on the packing assembly packing seal bottom.

2. The secondary packing arrangement of claim 1, wherein the barrier fluid pressure and the first well fluid quantity pressure are substantially balanced across the packing assembly packing seal.

3. The secondary packing arrangement of claim 1, wherein the barrier fluid pressure is not less than the first well fluid quantity pressure, across the packing assembly packing seal.

4. The secondary packing arrangement of claim 1, wherein the second well fluid quantity is routed from the housing first chamber to the pressure transmitter cylinder well fluid communication end.

5. The secondary packing arrangement of claim 1, wherein the well has a flow line transporting produced well fluids, and further wherein the second well fluid quantity is routed from the well flow line to the pressure transmitter cylinder well fluid communication end.

6. The secondary packing arrangement of claim 1, wherein the well has a casing, the well accumulating pressures gas in the casing, and further wherein the second well fluid quantity is routed from the casing to the pressure transmitter cylinder well fluid communication end.

7. The secondary packing arrangement of claim 1, wherein the packing assembly cylinder has a top portion and bottom portion, the bottom portion being sealed against the housing and against the top portion and affixed within the housing chamber for no movement, the top portion being free for lateral movement, the packing seal being positioned within the cylinder top portion.

8. The secondary packing arrangement of claim 1, wherein the housing top member bears upon the packing assembly cap, the barrier fluid passing laterally through the cap.

9. The secondary packing arrangement of claim 1, wherein the packing assembly cylinder has an upper and lower portion, the upper portion having a groove, and further comprising an o-ring positioned within the groove for sealing the cylinder upper portion against the cylinder lower portion, and further comprising a wave spring positioned between the housing top member and the packing assembly cap, such that the housing top member bears upon the packing assembly cap through the wave spring, thereby maintaining a load on the cylinder upper portion and the o-ring.

10. The secondary packing arrangement of claim 1, wherein the stuffing box threadably attaches to the housing top member.

11. The secondary packing arrangement of claim 1, wherein the barrier fluid is selected from the group consisting of hydrocarbon based, vegetable based, and animal fat based fluids.

12. The secondary packing arrangement of claim 1, wherein the retaining member comprises a washer and a snap ring, the washer being sized for a clearance between the washer and the polished rod, the snap ring expanding against the cylinder and supporting the washer, the washer supporting the packing seal.

13. The secondary packing arrangement of claim 1, wherein the pressure transmitter comprises means for adding additional barrier fluid.

14. The secondary packing arrangement of claim 1, wherein the pressure transmitter cylinder well fluid communication end has a hole, and further comprising a rod attached to the pressure transmitter cylinder piston, the rod extruding through the cylinder well fluid communication end hole, such that, as the amount of barrier fluid in the cylinder barrier fluid communication end and the housing second chamber decreases, the rod extrusion from the cylinder is decreased.

15. The secondary packing arrangement of claim 14, wherein the rod includes indicia related to the amount of barrier fluid.

16. The secondary packing arrangement of claim 1, wherein the pressure transmitter cylinder barrier fluid communication end has a hole, and further comprising a rod attached to the pressure transmitter cylinder piston, the rod extruding through the cylinder barrier fluid communication end hole, such that, as the amount of barrier fluid in the cylinder barrier fluid communication end and the housing second chamber decreases, the rod extrusion from the cylinder is increased.

17. The secondary packing arrangement of claim 1, wherein the rod includes indicia related to the amount of barrier fluid.

18. The secondary packing arrangement of claim 1, wherein the well fluid is within the group consisting of water, oil, and hydrocarbon gas.

19. For a well producing at least first and second quantities of well fluids, and in combination with a reciprocating plunger type pump having a polished rod, and a stuffing box through which the polished rod moves, the stuffing box providing a stuffing box packing seal, a secondary packing arrangement through which the polished rod moves, the secondary packing arrangement comprising:

a housing having a top member and a chamber;

a packing assembly, positioned within the housing chamber, through which the polished rod moves, the packing assembly having:

a cylinder, the cylinder having an outer wall sealed against the housing;

a lower packing seal, having at least one packing seal element, the packing seal having a top and a bottom, the packing seal and the cylinder dividing the housing chamber into a first chamber and a second chamber, the first chamber containing the first well fluid quantity;

a retaining member supporting the packing seal, such that the first well fluid quantity pressures the lower packing seal bottom; and a cap on the cylinder, the cap having:

a first member and a second member, the polished rod moving through the first and second members, the first member having fluid passages;

an intermediate packing seal, the intermediate packing seal being positioned adjacent the polished rod by the first and second members;

the cap first member being sealed against the housing and against the second member, the cap defining a third chamber between the cap and the stuffing box packing seal;

a barrier fluid in the housing second chamber, the barrier fluid pressurably engaging both the lower and intermediate packing seals through the cap second member fluid passages; and a pressure transmitter having a cylinder and a piston within the cylinder, the cylinder having a well fluid communication end, the well fluid communication end fluidically communicating with the second well fluid quantity such that the second well fluid quantity pressures the piston, the cylinder having a barrier fluid communication end, the barrier fluid communication end fluidically communicating with the housing second chamber, such that the barrier fluid pressurably engages the piston;

the piston being sized such that the pressure from the second well fluid quantity on the piston is transmitted to the barrier fluid, the barrier fluid pressure opposing the first well fluid quantity pressure exerted by the first well fluid quantity on the packing assembly packing seal bottom.

20. The secondary packing arrangement of claim 19, wherein the barrier fluid pressure and the first well fluid quantity pressure are substantially balanced across the packing assembly packing seal.

21. The secondary packing arrangement of claim 19, wherein the barrier fluid pressure is not less than the first well fluid quantity pressure, across the packing assembly packing seal.

22. The secondary packing arrangement of claim 19, wherein the second well fluid quantity is routed from the housing first chamber to the pressure transmitter cylinder well fluid communication end.

23. The secondary packing arrangement of claim 19, wherein the well has a flow line transporting produced well fluids, and further wherein the second well fluid quantity is routed from the well flow line to the pressure transmitter cylinder well fluid communication end.

24. The secondary packing arrangement of claim 19, wherein the well has a casing, the well accumulating press red gas in the casing, and further wherein the second well fluid quantity is routed from the casing to the pressure transmitter cylinder well fluid communication end.

25. The secondary packing arrangement of claim 19, further comprising a fitting for introducing a fluid into the third chamber.

26. The secondary pacing arrangement of claim 25, further comprising a wick material positioned about the polished rod in the third chamber, for absorbing the introduced fluid in the third chamber and applying the fluid to the polished rod.

27. The secondary packing arrangement of claim 25, wherein the introduced fluid is the same as the barrier fluid.

28. The secondary packing arrangement of claim 25, wherein the fitting is a grease fitting.

* * * * *